US007238144B2

(12) United States Patent
Ferrara

(10) Patent No.: US 7,238,144 B2
(45) Date of Patent: Jul. 3, 2007

(54) FACIAL AND NECK MUSCLE EXERCISING DEVICE

(76) Inventor: Yolanda Carmen Ferrara, 9421 Hollyhock Ct., Davie, FL (US) 33328-6754

( * ) Notice: Subject to any disclaimer, the term of this patent is extended or adjusted under 35 U.S.C. 154(b) by 101 days.

(21) Appl. No.: 11/005,649

(22) Filed: Dec. 6, 2004

(65) Prior Publication Data

US 2006/0122036 A1 Jun. 8, 2006

(51) Int. Cl.
*A63B 23/03* (2006.01)
*A63B 21/02* (2006.01)
*A63B 21/05* (2006.01)

(52) U.S. Cl. ..... 482/11; 482/124; 482/128

(58) Field of Classification Search ..... 482/10–11, 482/124–128, 140
See application file for complete search history.

(56) References Cited

U.S. PATENT DOCUMENTS 959,684 A * 5/1910 Adelman ..... 600/238
3,938,508 A 2/1976 Buckner
4,671,260 A 6/1987 Buckner
6,203,471 B1 3/2001 Akihiro
6,406,404 B1 * 6/2002 Chu ..... 482/11

* cited by examiner

*Primary Examiner*—Jerome Donnelly
*Assistant Examiner*—Fenn C. Mathew
(74) *Attorney, Agent, or Firm*—Michael Ries

(57) ABSTRACT

A facial and neck muscle exercising device for positioning against opposite corners of a person's mouth at the opening thereof to strengthen and tone facial and neck muscles. The exercising device includes a pair of mouth spreading arms each having an elongate slide member and an end member contoured to engage the opposite corners of the person's mouth. The slide members are slidably connected together longitudinally and an arm retaining device connected thereto controls sliding movement and resistance of the mouth spreading arms. Versions of the arm retaining device elastically bias the end members against the corners of the person's mouth in an adjustable manner, allow adjustment of the length or range of motion of the exercising device, retain the exercising device at a fixed length, or a combination thereof.

10 Claims, 17 Drawing Sheets

106
10a
10b

FACIAL AND NECK MUSCLE EXERCISING DEVICE

BACKGROUND OF THE INVENTION

1. Field of the Invention

The present invention relates generally to the field of exercise devices to strengthen and tone the neck and facial muscles, particularly the muscles surrounding the mouth. More specifically the present invention relates to a facial and neck muscle exercising device for positioning against opposite corners of a person's mouth at the opening thereof to strengthen facial, neck, and mouth muscles. The exercising device comprises first and second mouth spreading arms which include respective end members that are spaced apart and adapted to engage the opposite corners of the person's mouth and respective elongate slide members slidably connected together to vary the spacing of the end members. An arm retaining device is connected to the slide members adapted to control relative sliding movement of the mouth spreading arms to control the spacing and movement of the end members against the corners of the person's mouth as the muscles are flexed and relaxed during exercise.

2. Description of the Prior Art

The face area of a person is the most often viewed part of a person's body and as such is of prime interest for enhancement and rehabilitation due to the rigors of aging, illness, surgery, and injury. During the aging process, skin loses elasticity with consequent development of wrinkles and drooping. Likewise, the muscle tone of the underlying muscles is lost as reflected by less bulk and lengthening thereof resulting in less support for the overlying skin which accentuates the drooping and wrinkling of the skin. Medical illnesses such as strokes often cause loss of nervous system input to muscles of the body including the facial muscles resulting in drooping in the facial muscles such as the lips, unconsciously driveling, dropping of food during chewing, difficulty swallowing, and speaking unclearly, and other interference with chewing, swallowing and speaking. Additionally, surgery and injuries from accidents such as fires can cause scarring of the skin which scar tissue is less elastic than unscarred skin. This can cause disfigurement and loss of function such as at the mouth area which can cause constriction thereof leading to difficulty in chewing, swallowing and speaking.

Surgery such as face lifts is widely touted as the way to restore youthfulness to the facial area but has inherent risks of deformity due to lack of expertise by the surgeon conducting the procedure and infection due to unsanitary surgical conditions. Originally, face lifts consisted of slitting the skin at the hair line, pulling the skin upwardly taut, cutting away the excess skin, and stitching the slit back together. While this provided a temporary two to five year improvement in looks, the skin eventually stretched back to the droopy state due to lingering attachment to the underlying toneless facial muscles. The more recently improved facelifts go a step further by surgically separating the skin from the underlying facial muscles, slitting and shortening the facial muscles, and stitching the slits back together. This modern face lift lasts much longer since the skin reattaches to the underlying muscles which now have improved tone due to the shortening thereof. While surgery such as face lifts is widely touted as the way to reinvigorate or restore function to the facial area, surgery has the inherent risks of deformity and infection.

A recent alternative to surgery that is much less invasive is a Botox™ treatment which is the injection of Botulism toxin into the facial area to selectively paralyze the facial muscles. This treatment alleviates tension on the facial skin caused by voluntary and involuntary contractions thereof which allows the facial skin to extend to a completely relaxed condition wherein wrinkles are minimized. While the treatment may reduce the degree of wrinkles on the face, there is no toning of the affected facial muscles to help fill out the face and reduce the appearance of wrinkles. Conversely, the non-use of the affected muscles actually causes atrophy and shrinking thereof. The treatment is not entirely risk-free and must be done by trained personnel to prevent permanent nerve damage and facial paralysis. The treatment often produces unnatural facial expressions due to the combination of paralyzed and non-paralyzed muscles. The treatments wear off and must be repeated at three to four month intervals to retain the desired degree of paralysis of the facial muscles.

There have been various devices developed over the years to exercise the facial muscles for enhancing the look of the facial area to look younger and for rehabilitation following illness, surgery, or injury.

A facial exerciser designed for exercising the muscles of the face, chin and neck is disclosed in Buckner, U.S. Pat. No. 4,671,260 issued on Jun. 9, 1987. The facial exerciser includes a pair of spreader bars each having a lip engaging end member at a distal end thereof and a coupler at a proximal end thereof. Each coupler includes a longitudinal groove into which the shank of the other coupler is snapped to connect the shanks together in parallel so as to be slidable with respect to one another. Each coupler includes a creased outer edge for retaining an elastic band thereto to bias apart the lip engaging pieces to provide resistance to constriction of the person's lips. While the facial exerciser provides biasing apart of the spreader bars, the amount of biasing is not adjustable other than by switching to elastic bands of greater or lesser strength. Likewise, adjustment of the length of the facial exerciser is not adjustable.

Buckner also discloses an oral appliance for burn patients in earlier U.S. Pat. No. 3,938,508 issued on Feb. 17, 1976. The oral appliance is for persons who have suffered facial burns to prevent shrinkage of the tissues around the mouth and lips during the healing process. The oral appliance is similar to the facial exerciser except that the spreader bars are fixedly retained together at a desired position. The couplers are adjustable for the appliance to fit the person's mouth and can be progressively widened the opening of the mouth if shrinkage thereof has occurred. While the length of the oral appliance is adjustable, the spreader bars are rigidly affixed together during use rather than being biased apart elastically.

It is thus an object of the present invention to provide a facial muscle and neck muscle exercising device which is of adjustable bias without changing any elastic members.

It is another object of the present invention to provide a facial and neck muscle exercising device which is of adjustable length and resistance strength.

It is a still further object of the present invention to provide a facial and neck muscle exercising device which tones facial muscles and muscles of the neck to reduce wrinkles and drooping and provide an enhanced younger appearance.

It is still another object of the present invention to provide such a facial and neck muscle exercising device which rehabilitates and restores facial and neck muscles damaged due to aging or from illness, surgery, or injury.

It is yet another object of the present invention to provide such a facial and neck muscle exercising device which is easy to use, lightweight, durable, and compact.

It is finally an object of the present invention to provide such a facial and neck muscle exercising device which is comfortable to use.

SUMMARY OF THE INVENTION

The present invention accomplishes the above-stated objectives, as well as others, as may be determined by a fair reading and interpretation of the entire specification.

A facial and neck muscle exercising device is provided for positioning against opposite corners of a person's mouth at the opening thereof to strengthen facial, neck, and mouth muscles. The exercising device comprises first and second mouth spreading arms which include respective end members that are spaced apart and adapted to engage the opposite corners of the person's mouth and respective elongate slide members slidably connected together to vary the spacing of the end members. An arm retaining device is connected to the slide members adapted to control relative sliding movement of the mouth spreading arms to control the spacing and movement of the end members against the corners of the person's mouth as the muscles are flexed and relaxed during exercise.

The end members are preferably of substantially U-shape to fit the corners of the person's mouth, comprising respective inner and outer legs adapted to respectively extend internally and externally of the person's mouth interconnected by a curved base leg. The mouth spreading arms preferably include at least one comfort feature such as the end members having legs which diverging slightly, the end members having legs with middle portions of increased surface area, and the mouth spreading arms having a forwardly curved portion disposed between the end member and the slide member.

The slide members may be of a telescoping type wherein the slide member of the first mouth spreading arm has a slide bore which extends into a distal end thereof opposite its end member. The slide member of the second mouth spreading arm is adapted to be closely slidably received in the slide bore in a telescoping manner. The arm retaining device is adapted to prevent complete separation of the mouth spreading arms by the first mouth spreading arm having an internal locking shoulder formed within the slide bore at the distal end of its slide member. The slide member of the second mouth spreading arm has an external locking shoulder adapted to engage the internal locking shoulder at full extension of the mouth spreading arms to prevent subsequent complete separation thereof.

The slide members may alternatively be of a flanged type wherein the slide member of the first mouth spreading arm is comprised of a semi-circular support half and an integral T-shaped flange. The slide member of the second mouth spreading arm is comprised of a semi-circular support half and a pair of integral L-shaped flanges adapted to closely slidably engage the T-shaped flange. The arm retaining device is adapted to prevent complete separation of the mouth spreading arms by each slide member having a resilient wedge dependent from a distal end thereof opposite its end member. The wedges include respective ramp surfaces adapted to interact during initial sliding together of the mouth spreading arms to deflect the wedges to pass by one another. Respective locking shoulders are adapted to interact at full extension of the mouth spreading arms to prevent subsequent complete separation thereof.

The arm retaining device may include a spring device, preferably of adjustable bias, adapted to provide a longitudinal force resistant to relative sliding movement of the mouth spreading arms to longitudinally bias and retain the end members at a desired spacing. A first spring device useable with both types of slide members comprises a bellows tube disposed about the slide members. The bellows tube has a first end adapted to connect to the slide member of the first mouth spreading arm, a middle comprised of a plurality of resilient bellows, and a second end adapted to be secured to the slide member of the second mouth spreading arm. A second spring device also useable with both types of slide members comprises an elastic member such as an elastic band disposed externally of the slide members. The elastic band has a first end adapted to connect to the slide member of the first mouth spreading arm and a second end adapted to be secured to the slide member of the second mouth spreading arm. A third spring device useable with the telescoping type slide members comprises a compression spring and a tension adjuster disposed internally of the slide member of the first mouth spreading arm. The compression spring has a first end adapted to abut the tension adjuster and a second end adapted to abut the slide member of the second mouth spreading arm.

The arm retaining device may include a ratchet device of adjustable length adapted to longitudinally retain the end members at a desired spacing. The ratchet device is useable with the flange type slide members comprising respective opposing pluralities of ratchet teeth which extend longitudinally along the slide members biased to a locked position by a by at least one resilient member.

A first preferred embodiment of the facial and neck muscle exercising device includes the slide members of the telescoping type and the first spring device or bellows tube. The slide member of the second mouth spreading arm has a tab clearance bore which extends into a distal end thereof opposite its end member. A pair of resilient retaining tabs extend radially outwardly from the distal end formed as part of an annular external flange defined by a plurality of tab slits which extend longitudinally inwardly from the distal end. The retaining tabs are adapted to flex radially inwardly to allow passage thereof into the slide bore each having an external locking shoulder adapted to engage the internal locking shoulder. The first end of the bellows tube is adapted to connect to the slide member of the first mouth spreading arm at a plurality of tension adjustment tabs disposed longitudinally therealong which define a plurality of resistance setting positions and a mating tension adjustment slot at the first end of the bellows tube. The second end of the bellows tube is adapted to be secured to the slide member of the second mouth spreading arm at a plurality of positions using a pair of length adjustment grooves disposed radially oppositely on the slide member of the second mouth spreading arm. Each of the length adjustment grooves has a plurality of length adjustment portions interconnected by a plurality of stop portions which respectively extend generally longitudinally and transversely thereof. A pair of length adjustment pins are inwardly dependent from the second end adapted to slidably engage corresponding of the length adjustment grooves in unison as the spacing member is moved.

A second preferred embodiment of the facial and neck muscle exercising device includes the slide members of the flanged type and the first spring device or bellows tube. The first end of the bellows tube is adapted to connect to the slide member of the first mouth spreading arm at a plurality of tension adjustment slots disposed longitudinally therealong which define a plurality of resistance setting positions and a mating tension adjustment tab at the first end of the bellows tube. The second end of the bellows tube is adapted to be secured to the slide member of the second mouth spreading arm at a plurality of positions using a plurality of length adjustment ribs longitudinally spaced along the slide member of the second mouth spreading arm. An annular end wall is inwardly dependent from the second end of the bellows tube with a central hole which defines an inner periphery thereof adapted to closely fit about the slide member and individually engage the ribs as the spacing member is moved.

A third preferred embodiment of the facial and neck muscle exercising device includes the slide members of the flanged type and the second spring device or elastic band. The first end of the elastic band is adapted to connect to the slide member of the first mouth spreading arm at a plurality of hooks disposed longitudinally therealong which define a plurality of resistance setting positions. The second end of the elastic band is adapted to connect to the slide member of the second mouth spreading arm at another hook.

A fourth preferred embodiment of the facial and neck muscle exercising device includes the slide members of the flanged type and the ratchet device. The slide members are adapted to allow slight relative movement in a perpendicular direction thereto. The slide members are biased to the locked position with the pluralities of ratchet teeth engaged by at least one resilient member such as a leaf spring, a resilient strip, or a resilient block affixed to at least one of the slide members. The slide members are movable to an unlocked position by application of hand force in the perpendicular direction to disengage the pluralities of ratchet teeth and allow longitudinal slipping thereof past one another to adjust the desired spacing of the end members.

A fifth preferred embodiment of the facial and neck muscle exercising device includes the slide members of the telescoping type and the third spring device or compression spring and tension adjuster. The slide bore of the first mouth spreading arm is of polygonal cross-section comprising a stepped slide bore including a larger slide portion and a smaller guide portion formed by an annular flange which extends inwardly into the slide bore at the distal end of the slide member. The slide member of the second mouth spreading arm comprises a head of mating polygonal cross-section to the slide portion of the slide bore and a connecting portion of smaller cross-section which connects the head to the end member thereof. The slide portion is adapted to closely slidably receive the connecting portion of the second mouth spreading arm which together with the guide portion defines the internal locking shoulder adapted to retain the head within the slide bore. The tension adjuster comprises a body adapted to closely slidably fit within the slide bore having a tension adjustment tab that extends radially outwardly from the body through a longitudinal guide slot of the slide member. The compression spring is disposed within the slide bore with the first end abutting the tension adjuster and the second end abutting the slide member of the second mouth spreading arm. A tubular housing is rotatably disposed about the slide members having a semi-spiral tension adjustment groove. A plurality of attachment elements in the form of dependent tab receiving slots extend longitudinally in the housing and terminate at respective stop shoulders to define a plurality of resistance setting positions adapted to receive selected of the tension adjustment tabs by rotating the housing.

BRIEF DESCRIPTION OF THE DRAWINGS

Various other objects, advantages, and features of the invention will become apparent to those skilled in the art from the following discussion taken in conjunction with the following drawings, in which:

FIG. 8*a* is a fragmentary side elevational view of the slide member of the first mouth spreading arm to the enlarged scale taken on the line 8*a*—8*a* of FIG. 8 with a T-shaped flange partially broken away, showing a pair of resilient wedges inwardly dependent from a distal end of the slide member.

FIG. 8*b* is a fragmentary side elevational view of the slide member of the second mouth spreading arm to the enlarged scale taken on the line 8*b*—8*b* of FIG. 8, showing a pair of L-shaped flanges which slidably engage the T-shaped flange of the first mouth spreading arm, and a pair of resilient wedges inwardly dependent from a distal end of the slide member to engage the wedges of the first mouth spreading arm preventing separation of the mouth spreading arms.

FIG. 10*a* is a fragmentary side elevational view of the slide member of the first mouth spreading arm to the enlarged scale taken on the line 10*a*—10*a* of FIG. 10 with a T-shaped flange partially broken away, showing a pair of resilient wedges inwardly dependent from a distal end of the slide member.

FIG. 10*b* is a fragmentary side elevational view of the slide member of the second mouth spreading arm to the enlarged scale taken on the line 10*b*—10*b* of FIG. 10, showing a pair of L-shaped flanges which slidably engage the T-shaped flange of the first mouth spreading arm, a pair of resilient wedges inwardly dependent from a distal end of the slide member to engage the wedges of the first mouth spreading arm to prevent separation of the mouth spreading arms, and a plurality of resilient length adjustment wedges inwardly dependent spaced therealong to define a plurality of length setting positions.

DETAILED DESCRIPTION OF THE PREFERRED EMBODIMENTS

Figure 1:
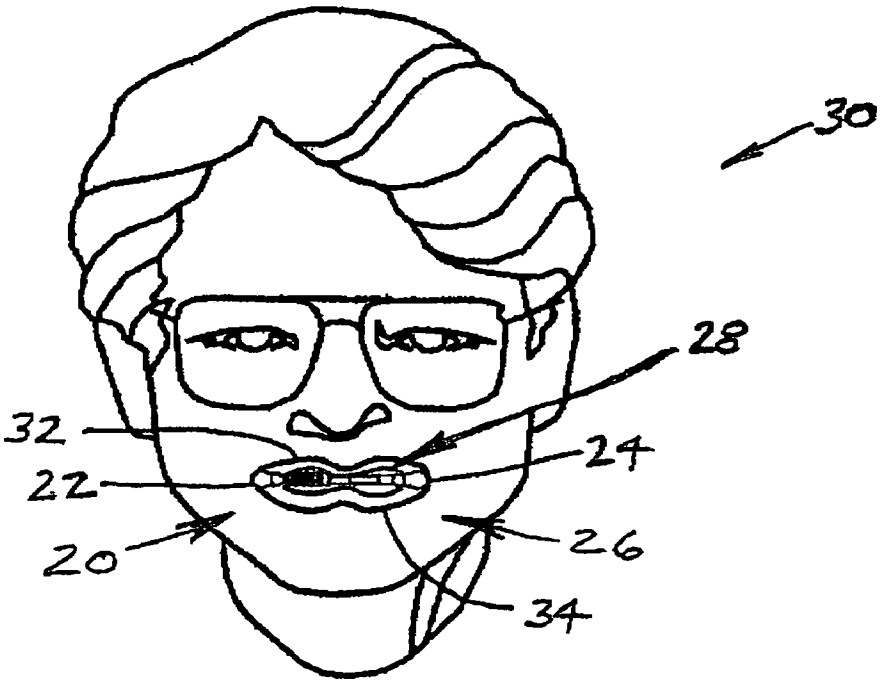
FIG. 1 is a front elevational view of a first embodiment facial and neck muscle exercising device of the present invention shown as received in the mouth of a person at the opening thereof to apply lateral force at respective of the corners of the person's mouth.
Figure 2:
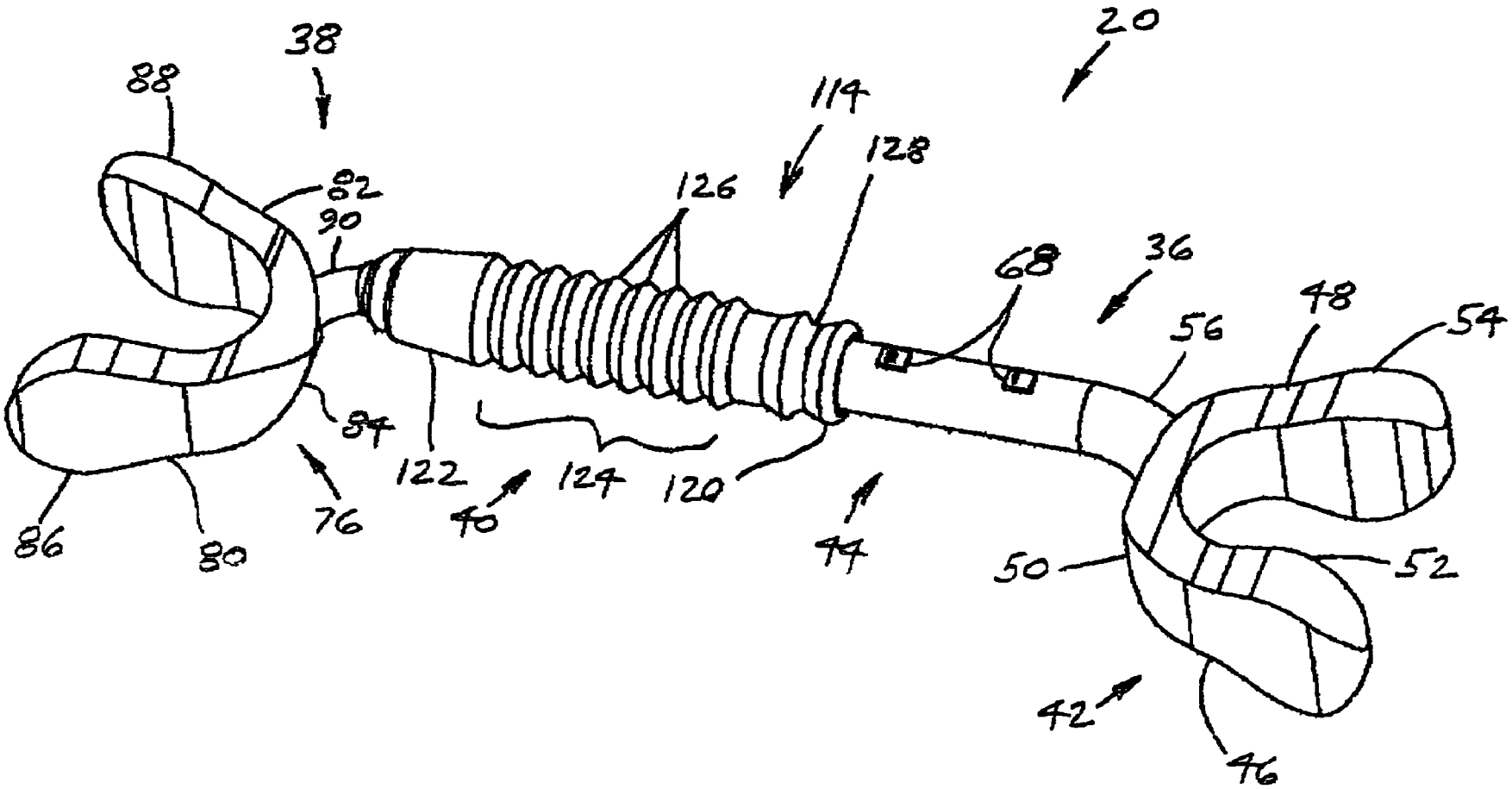
FIG. 2 is a perspective view of the exercising device, showing first and second mouth spreading arms which slidably telescope together and a resilient bellows tube disposed thereabout to longitudinally bias the spreading arms.
Figure 3:
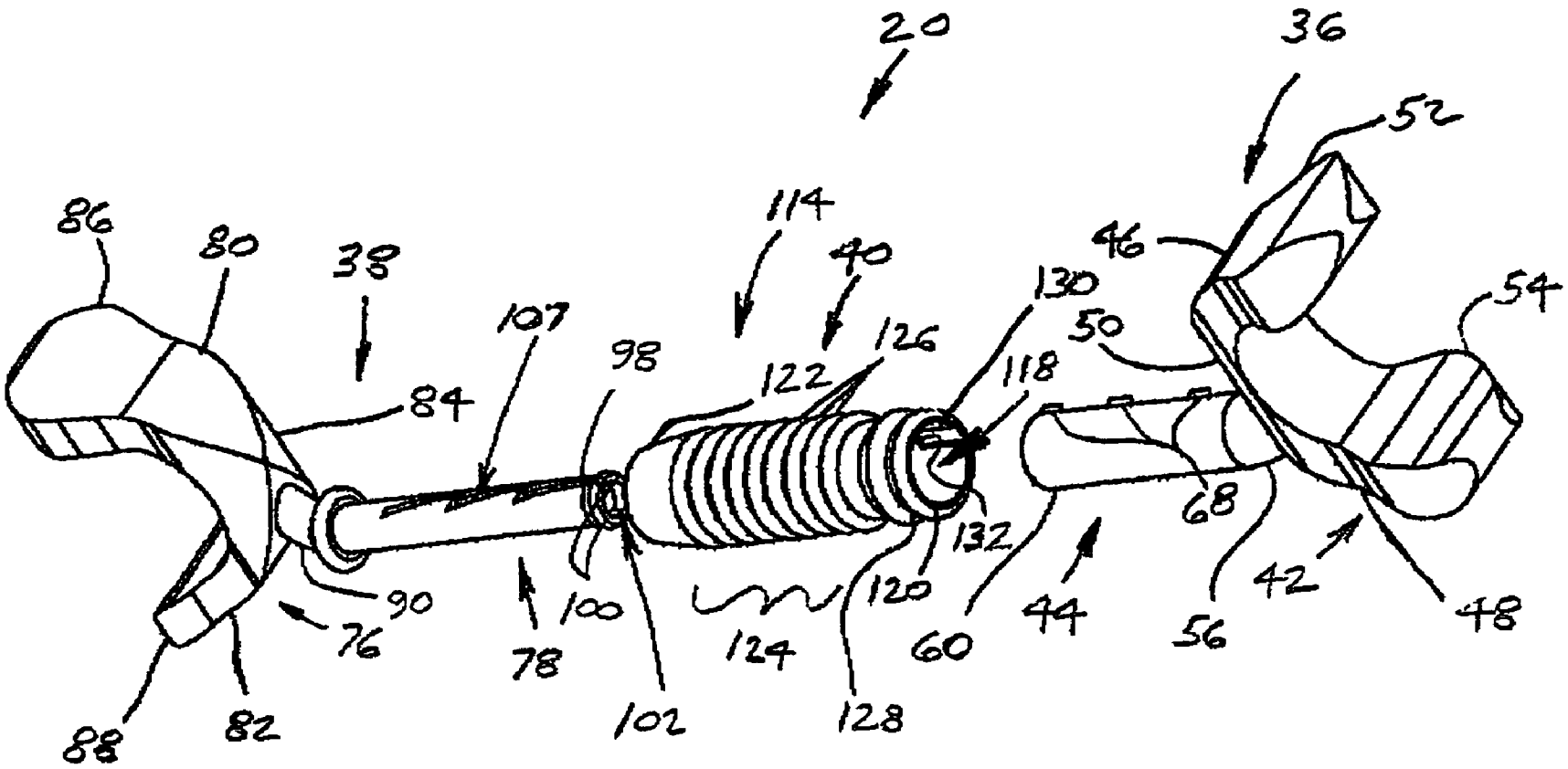
FIG. 3 is an exploded perspective view of the exercising device, showing the mouth spreading arms having respective U-shaped end members and dependent slide members.
Figure 4:
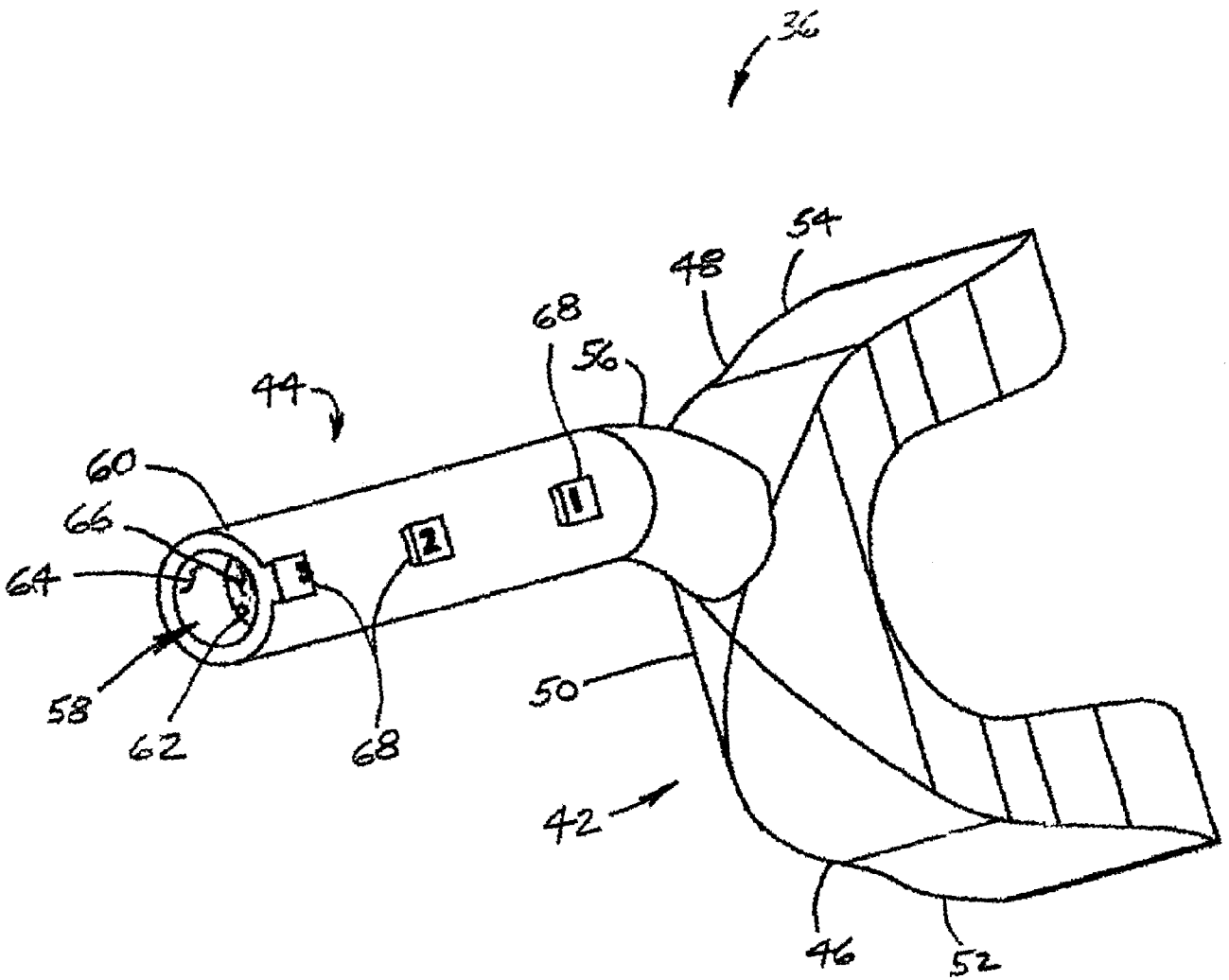
FIG. 4 is a perspective view of the first mouth spreading arm to an enlarged scale, showing the slide member having a stepped slide bore with an internal locking shoulder and a plurality of tension adjustment tabs which define a plurality of resistance setting positions.
Figure 5:
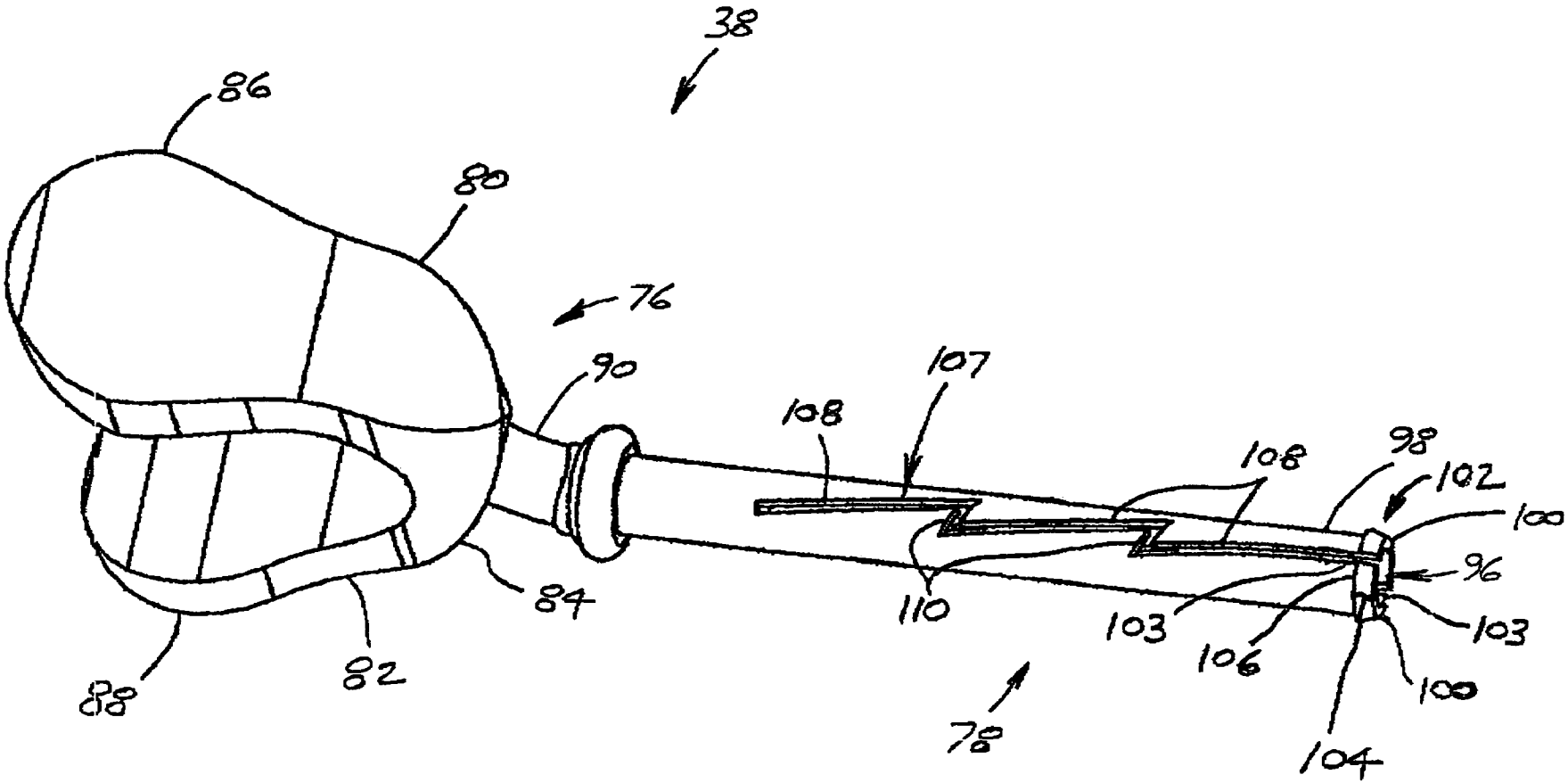
FIG. 5 is a perspective view of the second mouth spreading arm to the enlarged scale, showing the slide member with a tab clearance bore and a pair of mating retaining tabs which slidably fits into the slide bore to prevent separation of the mouth spreading arms, and a pair of longitudinal length adjustment grooves which define a plurality of length setting positions.
Figure 6:
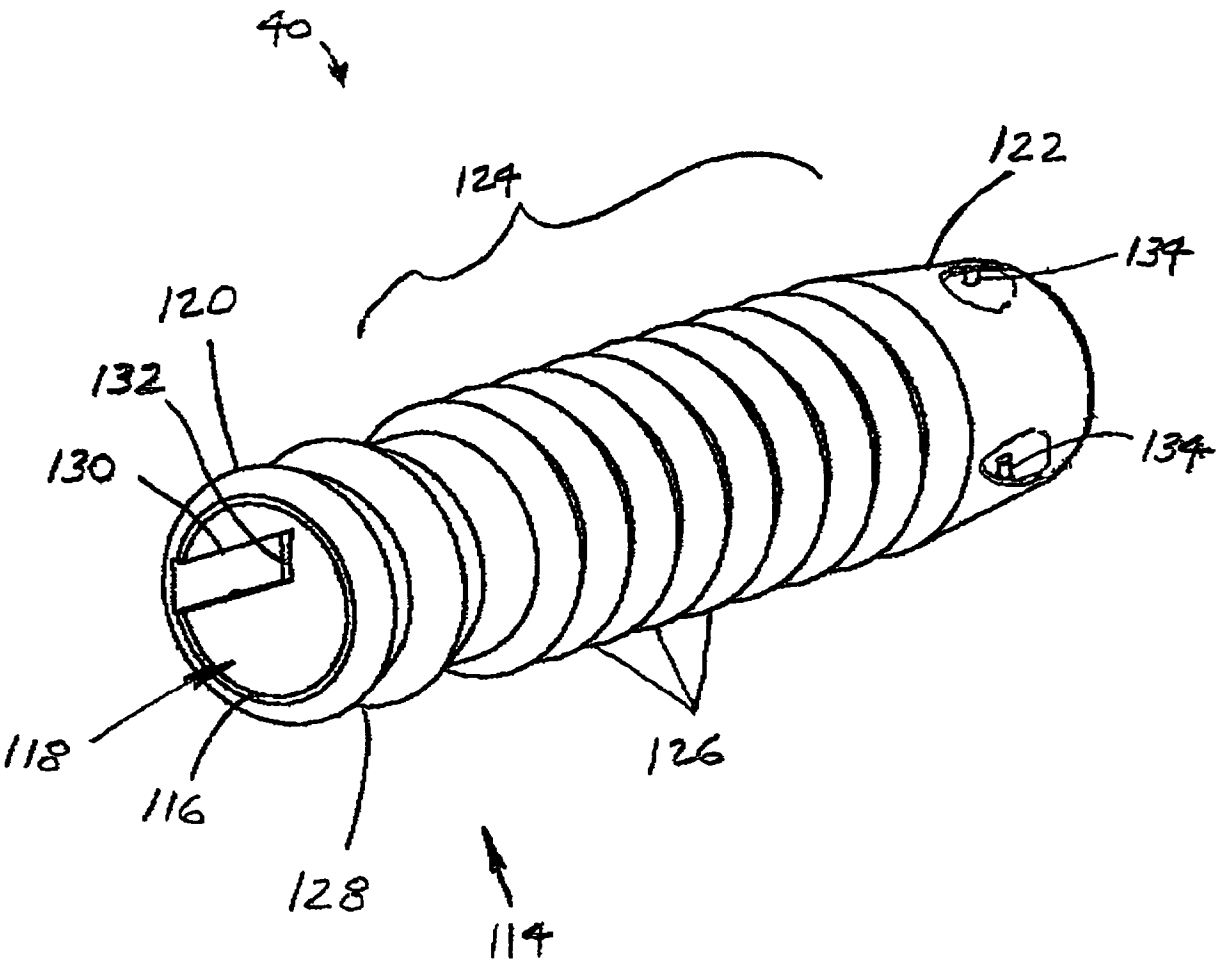
FIG. 6 is a partially broken perspective view of the bellows tube to a further enlarge scale, showing a middle portion with a plurality of resilient bellows, a first end with a mating tension adjustment slot to the tension adjustment tabs to provide adjustable bias, and a second end with a pair of mating length adjustment pins to the length adjustment grooves to provide adjustable length.

As required, detailed embodiments of the present invention are disclosed herein, however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Referring to FIG. 1, a first embodiment facial and neck muscle exercising device of the present invention, designated generally at 20, for positioning against opposite corners 22 and 24 of a person's mouth 26 at the opening 28 thereof to strengthen facial and mouth muscles (not shown). The exercising device 20 is shown as received in the mouth 26 of a person 30 to apply lateral force to the upper and lower lips 32 and 34 at respective of the corners 22 and 24 of the person's mouth 26 to strengthen sagging facial and mouth muscles and to provide therapy and rehabilitation after surgery.

As shown in FIGS. 2–6, the exercising device 20 includes respective first and second mouth spreading arms 36 and 38 which slidably telescope together, and an arm retaining device 40 connected thereto to control relative sliding movement of the mouth spreading arms 36 and 38 as the muscles are flexed and relaxed during exercise.

The first mouth spreading arm 36 includes an end member 42 and a dependent slide member 44. The end member 42 is of U-shape to fit the upper and lower lips 32 and 34 at the corners 22 and 24 of the person's mouth 26, and includes respective inner and outer legs 46 and 48 which respectively extend internally and externally of the person's mouth 26 interconnected by a curved base leg 50. The first mouth spreading arm 36 includes comfort features including the inner and outer legs 46 and 48 diverging slightly and having middle portions 52 and 54 of increased surface area to fit comfortably to the person's lips 32 and 34. The first mouth spreading arm 36 further includes an additional comfort feature of having a forwardly curved portion 56 disposed between the end member 42 and the slide member 44 to position the exercising device 20 forward of the person's teeth (not shown).

The slide member 44 of the first mouth spreading arm 36 has a stepped slide bore 58 which extends into a distal end 60 thereof opposite end member 42 with an internal locking shoulder 62. The slide bore 58 includes a smaller guide portion 64 and a larger slide portion 66 which define the internal locking shoulder 62 therebetween. A plurality of attachment elements in the form of tension adjustment tabs 68 of rectangular shaped cross-section are disposed longitudinally along the slide member 44 extending radially outwardly therefrom which define a plurality of resistance setting positions.

The second mouth spreading arm 38 includes an end member 70 and a dependent slide member 72. The end member 70 is of U-shape to fit the upper and lower lips 32 and 34 at the corners 22 and 24 of the person's mouth 26, and includes respective inner and outer legs 80 and 82 which respectively extend internally and externally of the person's mouth 26 interconnected by a curved base leg 84. The second mouth spreading arm 38 includes the comfort features including the inner and outer legs 80 and 82 diverging slightly and having middle portions 86 and 88 of increased surface area to fit comfortably to the person's lips 32 and 34. The second mouth spreading arm 38 further includes the additional comfort feature of having a forwardly curved portion 90 disposed between the end member 70 and the slide member 72 to position the exercising device 20 forward of the person's teeth.

The first and second mouth spreading arms 36 and 38 slidably telescope together by the slide member 72 of the second mouth spreading arm 38 being closely slidably received in the guide portion 64 of slide bore 58 in a telescoping manner.

The arm retaining device 40 prevents complete separation of the mouth spreading arms 36 and 38 by having a tab clearance bore 96 which extends into a distal end 98 of the slide member 72 of the second mouth spreading arm 38 opposite the end member 70. A pair of resilient retaining tabs 100 extend radially outwardly from the distal end 98 which are formed as part of an annular external flange 102 defined by a plurality of tab slits 103 which extend longitudinally inwardly from distal end 98. Each retaining tab 100 has a tapered surface 104 and may flex radially inwardly to allow passage thereof through the guide portion 64 of slide bore 58 and again flex outwardly to closely slidably fit within the larger slide portion 66 of slide bore 58. An external locking shoulder 106 of each retaining tab 100 then engages the internal locking shoulder 62 of the first mouth spreading arm 36 at full extension of the mouth spreading arms 36 and 38 to prevent subsequent complete separation thereof.

The slide member 72 has a pair of length adjustment depressions in the form of respective length adjustment grooves 107 disposed radially oppositely one another therealong each having a plurality of length adjustment portions 108 interconnected by a plurality of stop portions 110 which respectively extend generally longitudinally and transversely thereof which define a plurality of length setting positions.

The arm retaining device 40 longitudinally biases the end members 42 and 70 by including a spring device 112 which includes a spring member in the form of a resilient bellows tube 114 disposed around the slide members 44 and 72 which provides a longitudinal force resistant to relative sliding movement of the mouth spreading arms 36 and 38 to longitudinally bias the end members 42 and 70. The bellows tube 114 is comprised of a thin annular wall 116 which defines an elongate bore 118 therethrough. The bellows tube 114 has opposite first and second ends 120 and 122 retained to respective of the slide members 44 and 72 of the mouth spreading arms 36 and 38, and a middle portion 124 comprised of a plurality of resilient bellows 126. An annular finger gripping groove 128 is disposed at the second end 122.

The spring device 112 is of adjustable bias by the first end 120 of the bellows tube 114 having an attachment element in the form of a tension adjustment slot 130 of rectangular shaped cross-section which terminates at a stop shoulder 132. The tension adjustment slot 130 is of mating configuration to slidably receive the tension adjustment tabs 68.

The arm retaining device 40 positions the end members 42 and 70 at a desired spacing by the bellows tube 114 also functioning as a tubular spacer wherein the second end 122 is securable to the slide member 72 of the second mouth spreading arm 38 at a plurality of positions using a pair of transverse length adjustment pins 134 inwardly dependent into the bore 118 from the second end 122 to slidably engage corresponding of the length adjustment grooves 107. The length adjustment pins 134 are disposed radially oppositely one another and the length adjustment grooves 107 are disposed such that the length adjustment pins 134 can slide along the corresponding length adjustment grooves 107 in unison as the bellows tube 114 is moved. The length adjustment pins 134 engage a desired of the stop portions 110 to allow adjustment of the relative range of motion of the first and second mouth spreading arms 36 and 38.

The component parts of exercising device 20, as well as those embodiments which follow, are generally molded from a plastic material such as polypropylene, polyethylene, and polyvinyl chloride. Likewise, the component parts may be made in different sizes to accommodate different sized mouths 26.

Again referring to FIG. 1, the exercising device 20 is used by the person 30 by first adjusting the length of the exercising device 20 by slightly rotating and longitudinally moving the bellows tube 114 until the pins 134 engage a desired of the stop portions 110 of the length adjustment grooves 107. The resistance (pre-load) on the bellows tube 114 is then adjusted by laterally squeezing the finger gripping groove 128 between the thumb and index finger to make the first end 120 slightly oval in shape. This allows the tension adjustment tabs 68 to slip past the stop shoulder 132 as needed to place a desired thereof within the tension adjustment slot 130. The exercising device 20 is then longitudinally squeezed using the thumb and index finger against respective of the end members 42 and 70 to compress the bellows tube 114 sufficiently to be placed at the opening 28 of the mouth 26 with the end members 42 and 70 respectively engaging the corners 22 and 24 of the mouth 26. The end members 42 and 70 are then released to bias the corners 22 and 24 of the mouth 26. The curved portions 56 and 90 of the spreading arms 36 and 38 curve forwardly to provide clearance for the person's teeth. The person 30 exercises the facial muscles by contracting and enlarging the opening 28 of the mouth 26 against the resistance of the bellows tube 114 to exercise the facial muscles around the mouth and throughout the face.

Second Preferred Embodiment

Figure 7:
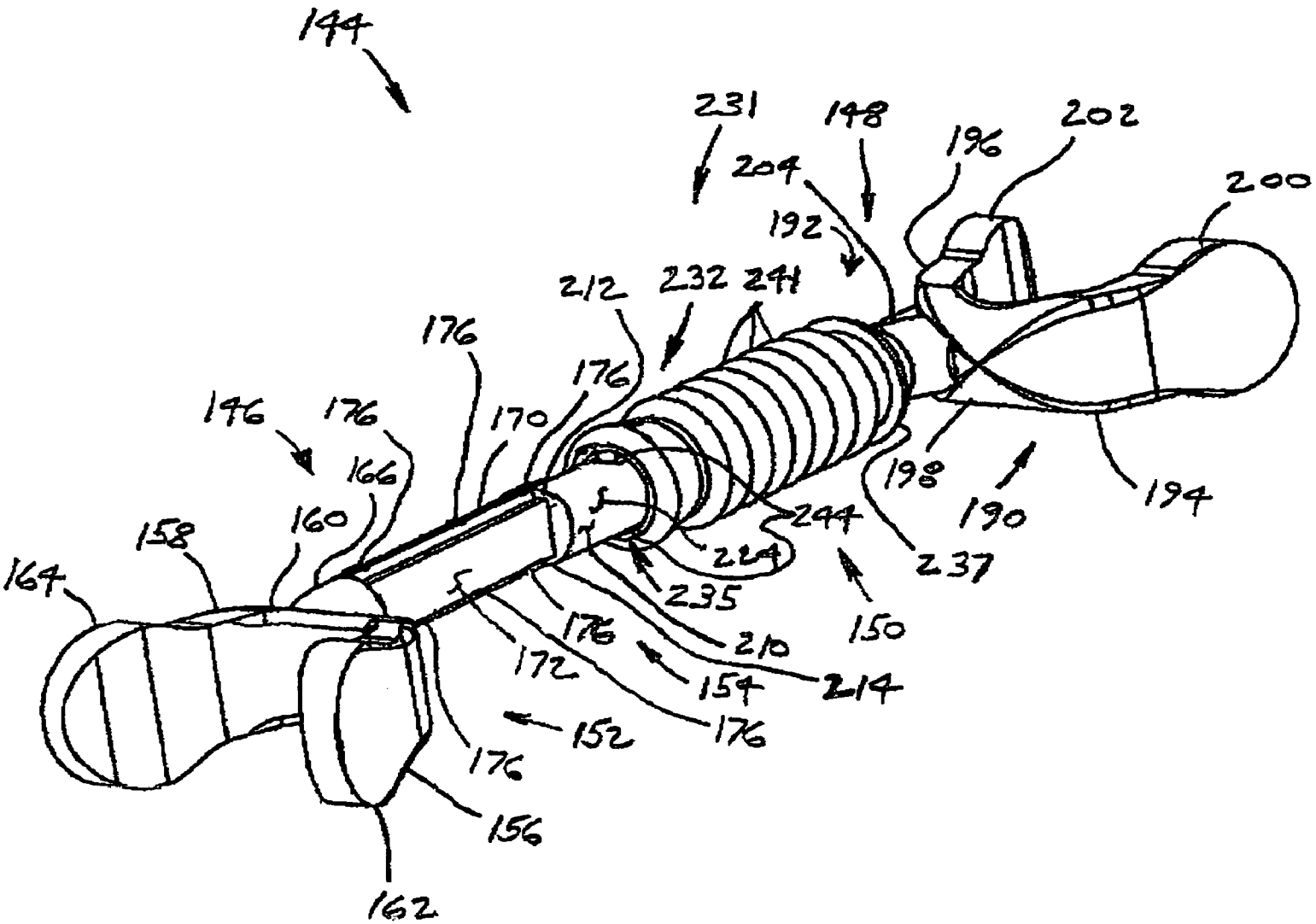
FIG. 7 is a perspective view of a second embodiment facial and neck muscle exercising device, showing first and second mouth spreading arms which slidably fit together and a resilient bellows tube disposed thereabout to longitudinally bias the spreading arms, the mouth spreading arms having respective U-shaped end members and dependent slide members.
Figure 8:
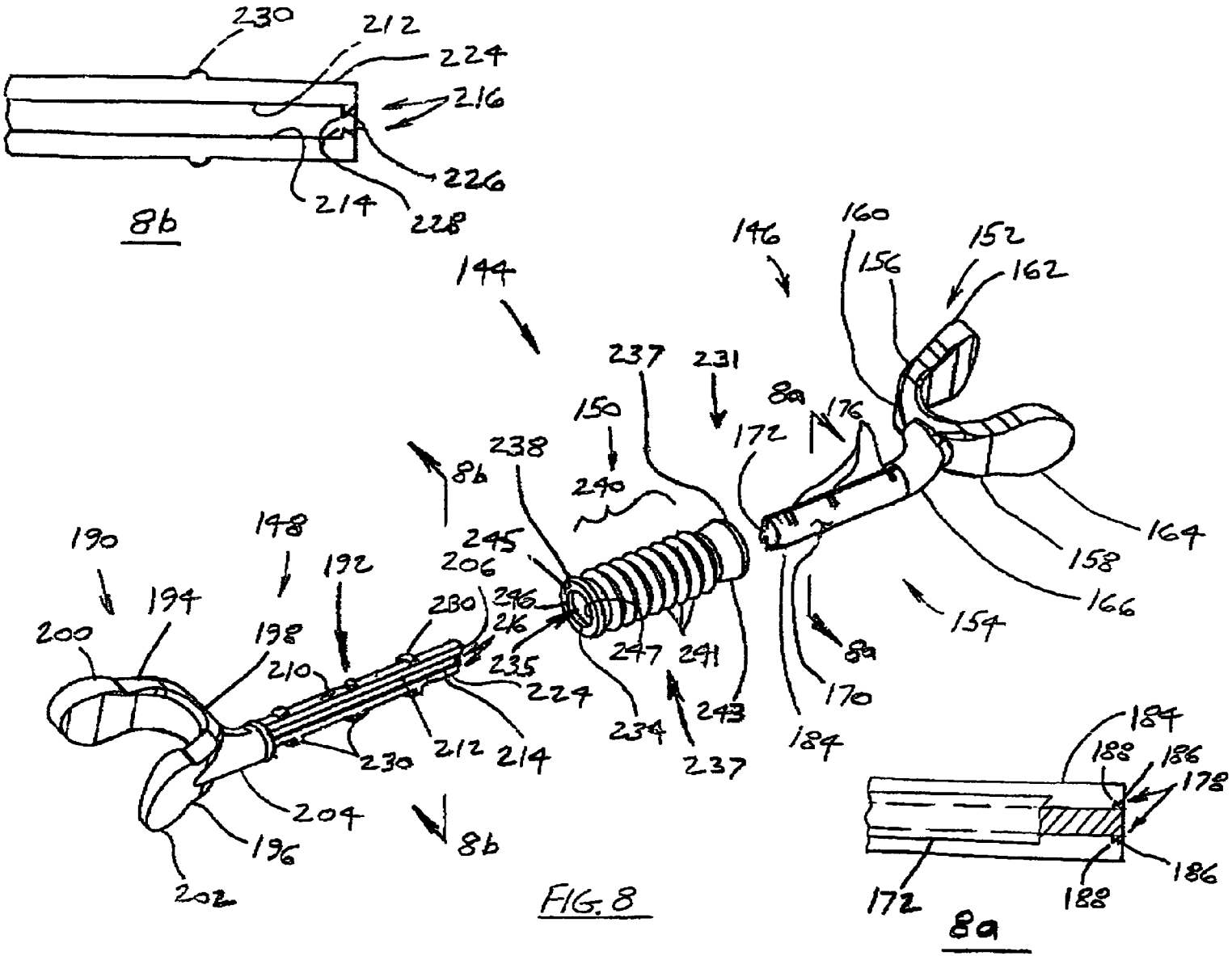
FIG. 8 is an exploded perspective view of the exercising device, showing the slide member of the first mouth spreading arm having a plurality of tension adjustment slots which define a plurality of resistance setting positions, the slide member of the second mouth spreading arm having a plurality of length adjustment ribs which define a plurality of length setting positions, and the bellows tube having a first end with a mating tension adjustment tab to the tension adjustment slots to provide adjustable bias, and a second end with an annular end wall with a central hole having an inner periphery which engages the length adjustment ribs to provide adjustable length.

Referring to FIGS. 7 and 8, a second embodiment facial and neck muscle exercising device 144 includes respective first and second mouth spreading arms 146 and 148 which slidably fit together, and an arm retaining device 150 connected thereto to control relative sliding movement of the mouth spreading arms 146 and 148 as the muscles are flexed and relaxed during exercise.

The first mouth spreading arm 146 includes an end member 152 and a dependent slide member 154. The end member 152 is of U-shape to fit the upper and lower lips 32 and 34 at the corners 22 and 24 of the person's mouth 26, and includes respective inner and outer legs 156 and 158 which respectively extend internally and externally of the person's mouth 26 interconnected by a curved base leg 160. The first mouth spreading arm 146 includes comfort features including the inner and outer legs 156 and 158 diverging slightly and having middle portions 162 and 164 of increased surface area to fit comfortably to the person's lips 32 and 34. The first mouth spreading arm 146 further includes an additional comfort feature of having a forwardly curved portion 166 disposed between the end member 152 and the slide member 154 to position the exercising device 144 forward of the person's teeth (not shown).

The slide member 154 of the first mouth spreading arm 146 has a semi-circular support half 170 and an integral T-shaped flange 172. A plurality of attachment elements in the form of tension adjustment slots 176 of rectangular shaped cross-section are disposed longitudinally along the slide member 154 which define a plurality of resistance setting positions. A pair of resilient wedges 178 extend inwardly dependent from a distal end 184 of the slide member 154 opposite the end member 152 each including a ramp surface 186 and a locking shoulder 188.

The second mouth spreading arm 148 includes an end member 190 and a dependent slide member 192. The end member 190 is of U-shape to fit the upper and lower lips 32 and 34 at the corners 22 and 24 of the person's mouth 26, and includes respective inner and outer legs 194 and 196 which respectively extend internally and externally of the person's mouth 26 interconnected by a curved base leg 198. The second mouth spreading arm 148 includes the comfort features including the inner and outer legs 194 and 196 diverging slightly and having middle portions 200 and 202 of increased surface area to fit comfortably to the person's lips 32 and 34. The second mouth spreading arm 148 further includes the additional comfort feature of having a forwardly curved portion 204 disposed between the end member 190 and the slide member 192 to position the exercising device 144 forward of the person's teeth.

The first and second mouth spreading arms 146 and 148 slidably fit together by the slide member 192 of the second mouth spreading arm 148 having a semi-circular support half 210 and a pair of integral L-shaped flanges 212 and 214 adapted to closely slidably fit to the T-shaped flange 172.

The arm retaining device 150 prevents complete separation of the mouth spreading arms 146 and 148 by the slide member 192 having a pair of resilient wedges 216 that extend inwardly dependent from a distal end 224 of the slide member 192 opposite the end member 190 each including a ramp surface 226 and a locking shoulder 228. The wedges 178 and 216 flex slightly when the ramp surfaces 186 and 226 interact during initial sliding together of the mouth spreading arms 146 and 148 to deflect the wedges 178 and 216 to pass by one another. The locking shoulders 188 and 228 interact at full extension of the mouth spreading arms 146 and 148 to prevent subsequent complete separation thereof.

A plurality of length adjustment ribs 230 are longitudinally spaced along the slide member 192 of the second mouth spreading arm 148. The length adjustment ribs 230 are of semi-circular shaped cross-section extending transversely thereof which define a plurality of length setting positions.

The arm retaining device 150 longitudinally biases the end members 152 and 190 by including a spring device 231 which includes a spring member in the form of a resilient bellows tube 232 disposed around the slide members 154 and 192 which provides a longitudinal force resistant to relative sliding movement of the mouth spreading arms 146 and 148 to longitudinally bias the end members 152 and 190. The bellows tube 232 is comprised of a thin annular wall 234 which defines an elongate bore 235 therethrough. The bellows tube 232 has opposite first and second ends 237 and 238 retained to respective of the slide members 154 and 192 of the mouth spreading arms 146 and 148, and a middle portion 240 comprised of a plurality of resilient bellows 241. An annular finger gripping groove 243 is disposed at the second end 238.

The spring device 231 is of adjustable bias by the first end 237 of the bellows tube 232 having an attachment element in the form of a pair of tension adjustment tabs 244 of rectangular shaped cross-section. The tension adjustment slots 176 are of mating configuration to receive the tension adjustment tabs 244.

The arm retaining device 150 positions the end members 152 and 190 at a desired spacing by the bellows tube 232 also functioning as a tubular spacer wherein the second end 238 is securable to the slide member 192 of the second mouth spreading arm 148 at a plurality of positions by an annular end wall 245 inwardly dependent from the second end 238 of bellows tube 232 with a central hole 246 which defines an inner periphery 247 thereof adapted to closely fit about the slide member 192 and individually engage the length adjustment ribs 230 as the bellows tube 232 is moved to allow adjustment of the relative range of motion of the first and second mouth spreading arms 146 and 148.

The tension adjustment tabs 244 of the spring device 231 are engaged with a desired pair of the tension adjustment slots 176 of the first mouth spreading arm 146 to adjust the lateral force exerted by the facial and mouth exercising device 144 on the corners 22 and 24 of the person's mouth 26.

The exercising device 144 is used by the person 30 by first adjusting the length of the exercising device 144 by rotating and longitudinally moving the bellows tube 232 such that the inner periphery 247 of the end wall 245 passes over the length adjustment ribs 230 to engage a desired thereof. The resistance (pre-load) on the bellows tube 232 is then adjusted by laterally squeezing the finger gripping groove 243 between the thumb and index finger to make the first end 237 slightly oval in shape. This allows the tension adjustment tabs 244 to slip past the tension adjustment slots 176 as needed to engage desired thereof. The exercising device 144 is then longitudinally squeezed using the thumb and index finger against respective of the end members 152 and 190 to compress the bellows tube 232 sufficiently to be placed at the opening 28 of the mouth 26 with the end members 152 and 190 respectively engaging the corners 22 and 24 of the mouth 26. The end members 152 and 190 are then released to bias the corners 22 and 24 of the mouth 26. The curved portions 166 and 204 of the spreading arms 146 and 148 curve forwardly to provide clearance for the person's teeth. The person 30 exercises the facial muscles by contracting and enlarging the opening 28 of the mouth 26 against the resistance of the bellows tube 232 to exercise the facial muscles around the mouth and throughout the face.

Third Preferred Embodiment

Figure 9:
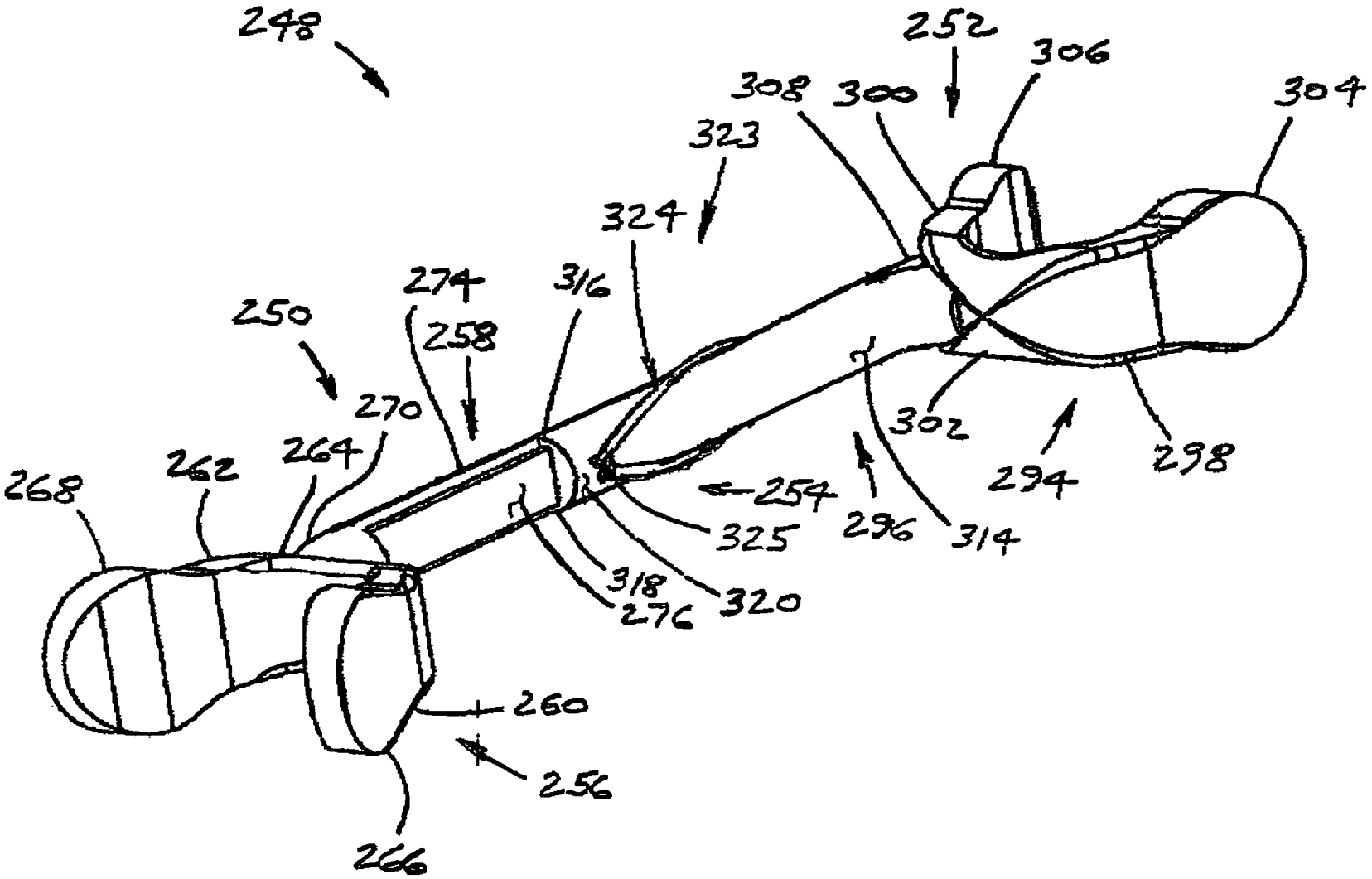
FIG. 9 is a perspective view of a third embodiment facial and neck muscle exercising device, showing first and second mouth spreading arms which slidably fit together and an elastic band disposed externally thereof to longitudinally bias the spreading arms, the mouth spreading arms having respective U-shaped end members and dependent slide members.
Figure 10:
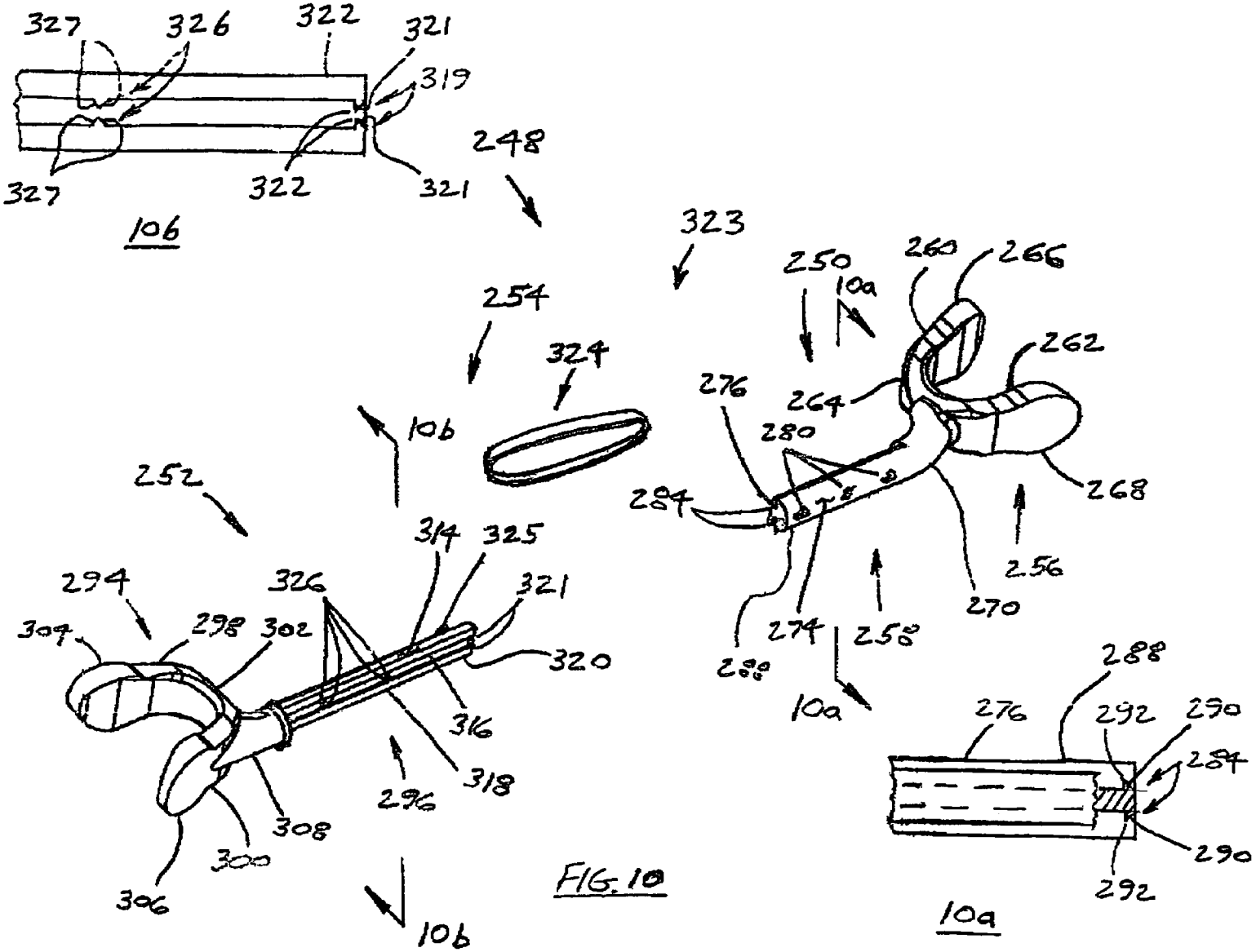
FIG. 10 is an exploded perspective view of the exercising device, showing the slide member of the first mouth spreading arm having a plurality of tension adjustment hooks which define a plurality of resistance setting positions, the slide member of the second mouth spreading arm having a single hook to retain the elastic band between to provide adjustable bias, the slide member of the first mouth spreading arm having a pair of resilient wedges inwardly dependent from a distal end of the slide member, and the slide member of the second mouth spreading arm having a pair of resilient wedges inwardly dependent from a distal end of the slide member which engage the wedges of the first mouth spreading arm preventing separation of the mouth spreading arms.

Referring to FIGS. 9 and 10, a third embodiment facial and neck muscle exercising device 248 includes respective first and second mouth spreading arms 250 and 252 which slidably fit together, and an arm retaining device 254 connected thereto to control relative sliding movement of the mouth spreading arms 250 and 252 as the muscles are flexed and relaxed during exercise.

The first mouth spreading arm 250 includes an end member 256 and a dependent slide member 258. The end member 256 is of U-shape to fit the upper and lower lips 32 and 34 at the corners 22 and 24 of the person's mouth 26, and includes respective inner and outer legs 260 and 262 which respectively extend internally and externally of the person's mouth 26 interconnected by a curved base leg 264. The first mouth spreading arm 250 includes comfort features including the inner and outer legs 260 and 262 diverging slightly and having middle portions 266 and 268 of increased surface area to fit comfortably to the person's lips 32 and 34. The first mouth spreading arm 250 further includes an additional comfort feature of having a forwardly curved portion 270 disposed between the end member 256 and the slide member 258 to position the exercising device 248 forward of the person's teeth (not shown).

The slide member 258 of the first mouth spreading arm 250 has a semi-circular support half 274 and an integral T-shaped flange 276. A plurality of attachment elements in the form of tension adjustment hooks 280 disposed longitudinally along the slide member 258 extending radially outwardly therefrom which define a plurality of resistance setting positions. A pair of resilient wedges 284 extend inwardly dependent from a distal end 288 of the slide member 258 opposite the end member 256 each including a ramp surface 290 and a locking shoulder 292.

The second mouth spreading arm 252 includes an end member 294 and a dependent slide member 296. The end member 294 is of U-shape to fit the upper and lower lips 32 and 34 at the corners 22 and 24 of the person's mouth 26, and includes respective inner and outer legs 298 and 300 which respectively extend internally and externally of the person's mouth 26 interconnected by a curved base leg 302. The second mouth spreading arm 252 includes the comfort features including the inner and outer legs 298 and 300 diverging slightly and having middle portions 304 and 306 of increased surface area to fit comfortably to the person's lips 32 and 34. The second mouth spreading arm 252 further includes the additional comfort feature of having a forwardly curved portion 308 disposed between the end member 294 and the slide member 296 to position the exercising device 248 forward of the person's teeth.

The first and second mouth spreading arms 250 and 252 slidably fit together by the slide member 296 of the second mouth spreading arm 252 having a semi-circular support half 314 and a pair of integral L-shaped flanges 316 and 318 adapted to closely slidably fit to the T-shaped flange 276.

The arm retaining device 254 prevents complete separation of the mouth spreading arms 250 and 252 by the slide member 296 having a pair of resilient wedges 319 that extend inwardly dependent from a distal end 320 of the slide member 296 opposite the end member 294 each including a ramp surface 321 and a locking shoulder 322. The wedges 284 and 319 flex slightly when the ramp surfaces 290 and 321 interact during initial sliding together of the mouth spreading arms 250 and 252 to deflect the wedges 284 and 319 to pass by one another. The locking shoulders 292 and 322 interact at full extension of the mouth spreading arms 250 and 252 to prevent subsequent complete separation thereof.

The arm retaining device 254 longitudinally biases the end members 256 and 294 by including a spring device 323 which includes a spring member in the form of an elastic member such as an elastic band 324 disposed externally of the slide members 258 and 296 which provides a longitudinal force resistant to relative sliding movement of the mouth spreading arms 250 and 252 to longitudinally bias the end members 256 and 294. The elastic band 324 is comprised of an elastic material such as natural or synthetic rubber and may be made in different lengths and elasticity.

The spring device 323 is of adjustable bias by the elastic band 324 being disposed around a hook 325 of the second mouth spreading arm 252 and a selected of the tension adjustment hooks 280 of the first mouth spreading arm 250 to adjust the lateral force exerted by the facial and mouth exercising device 248 on the corners 22 and 24 of the person's mouth 26. The elastic band 324 provides a longitudinal force resistant to relative sliding movement of the mouth spreading arms 250 and 252 to longitudinally bias the end members 256 and 294.

The arm retaining device 254 positions the end members 256 and 294 of the mouth spreading arms 250 and 252 at a desired spacing by the slide member 296 of the second mouth spreading arm 252 having a plurality of pairs of resilient length adjustment wedges 326 inwardly dependent longitudinally spaced along the slide member 296 each including a pair of ramp surfaces 327 and which define a plurality of length setting positions. The wedges 284 and 326 flex slightly when the ramp surfaces 290 and 327 interact during sliding of the mouth spreading arms 250 and 252 to deflect the wedges 284 and 326 to pass by one another upon application of sufficient hand force to allow adjustment of the relative range of motion of the first and second mouth spreading arms 250 and 252.

The exercising device 248 is used by the person 30 by first adjusting the length of the exercising device 248 by longitudinally moving the slide members 258 and 296 such that the wedges 284 of the first mouth spreading arm 250 pass the length adjustment wedges 326 of the second mouth spreading arm 252 to engage a desired thereof. The resistance (pre-load) on the elastic band 324 is then adjusted by placing the elastic band 324 around the hook 325 of second mouth spreading arm 252 and a desired of the tension adjustment hooks 280 of the first mouth spreading arm 250. The exercising device 248 is then longitudinally squeezed using the thumb and index finger against respective of the end members 256 and 294 to stretch the elastic band 324 sufficiently to be placed at the opening 28 of the mouth 26 with the end members 256 and 294 respectively engaging the corners 22 and 24 of the mouth 26. The end members 256 and 294 are then released to bias the corners 22 and 24 of the mouth 26. The curved portions 270 and 308 of the spreading arms 250 and 252 curve forwardly to provide clearance for the person's teeth. The person 30 exercises the facial muscles by contracting and enlarging the opening 28 of the mouth 26 against the resistance of the elastic band 324 to exercise the facial muscles around the mouth and throughout the face.

Fourth Preferred Embodiment

Figure 11:
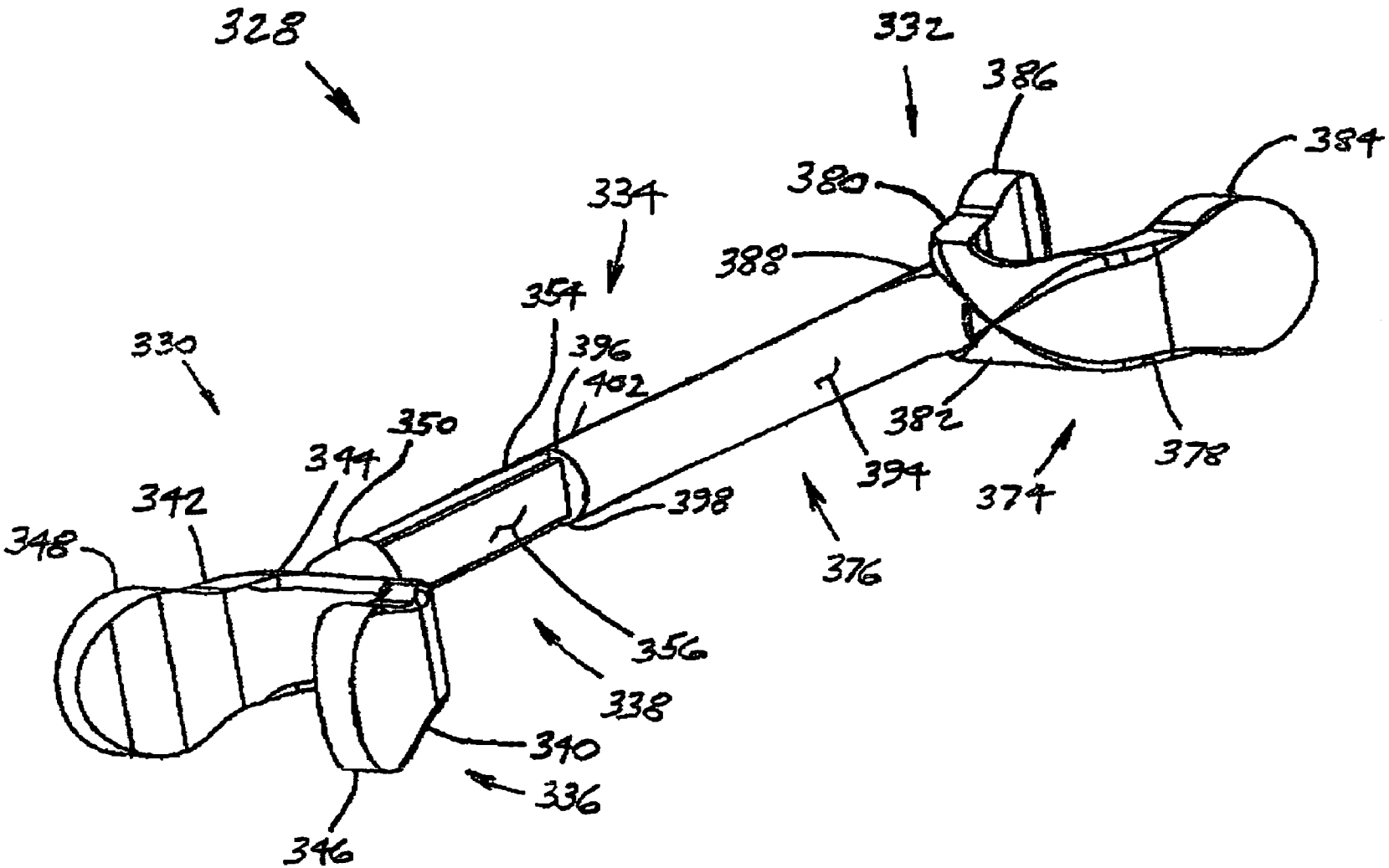
FIG. 11 is a perspective view of a fourth embodiment facial and neck muscle exercising device, showing first and second mouth spreading arms which slidably fit together in a ratcheting manner, and having a resilient leaf spring to longitudinally bias the spreading arms, the mouth spreading arms having respective U-shaped end members and dependent slide members.
Figure 12B:
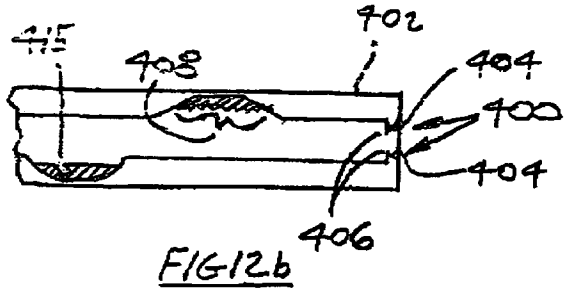
FIG. 12*b* is a fragmentary side elevational view of the slide member of the second mouth spreading arm to the enlarged scale taken on the line 12*b*—12*b* of FIG. 12, showing a pair of resilient wedges inwardly dependent from a distal end of the slide member to engage the wedges of the first mouth spreading arm to prevent separation of the mouth spreading arms, and a plurality of ratchet teeth disposed longitudinally along the slide member opposed to engage the ratchet teeth of the first mouth spreading arm biased together by the leaf spring to define a plurality of length setting positions.
Figure 12A:
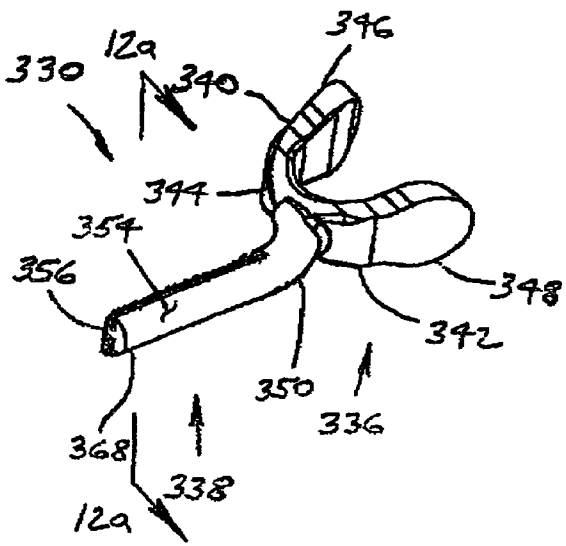
FIG. 12*a* is a fragmentary side elevational view of the slide member of the first mouth spreading arm to the enlarged scale taken on the line 12*a*—12*a* of FIG. 12 with the T-shaped flange partially broken away, showing a pair of resilient wedges inwardly dependent from a distal end of the slide member and a plurality of ratchet teeth disposed longitudinally along the slide member.
Figure 12A:
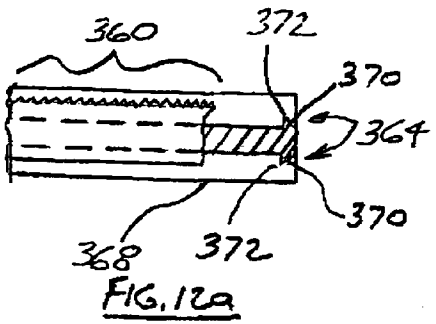
Figure 12:
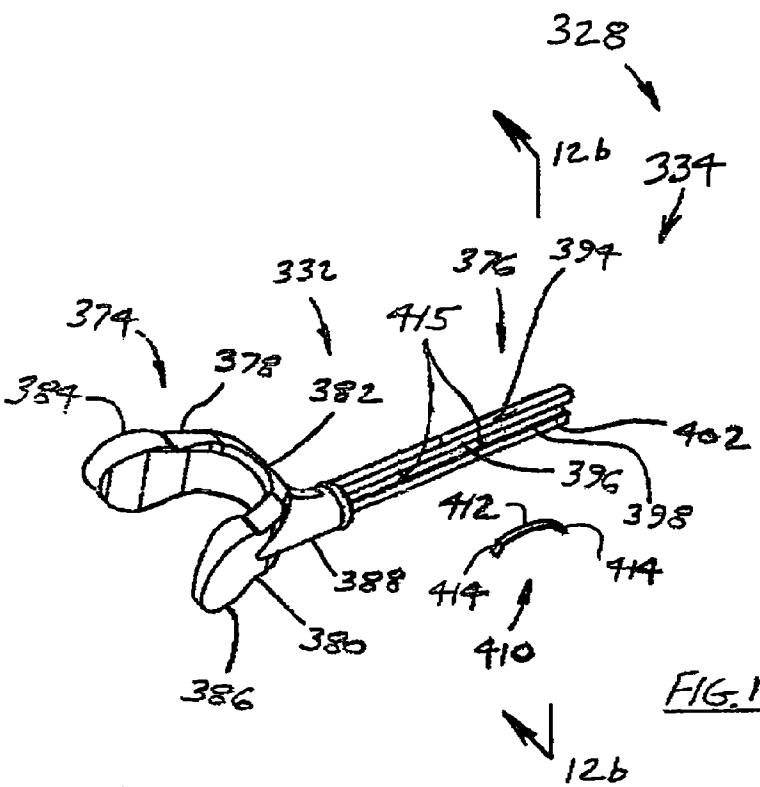
FIG. 12 is an exploded perspective view of the exercising device, showing the slide members each having a semicircular support half and respective of a T-shaped flange and ratcheting slidably mating L-shaped flanges, the leaf spring having a curved middle portion and a pair of straight end tabs that fit into respective slots of the second mouth spreading arm to bias the mouth spreading arms to a locked position.
Figure 13:
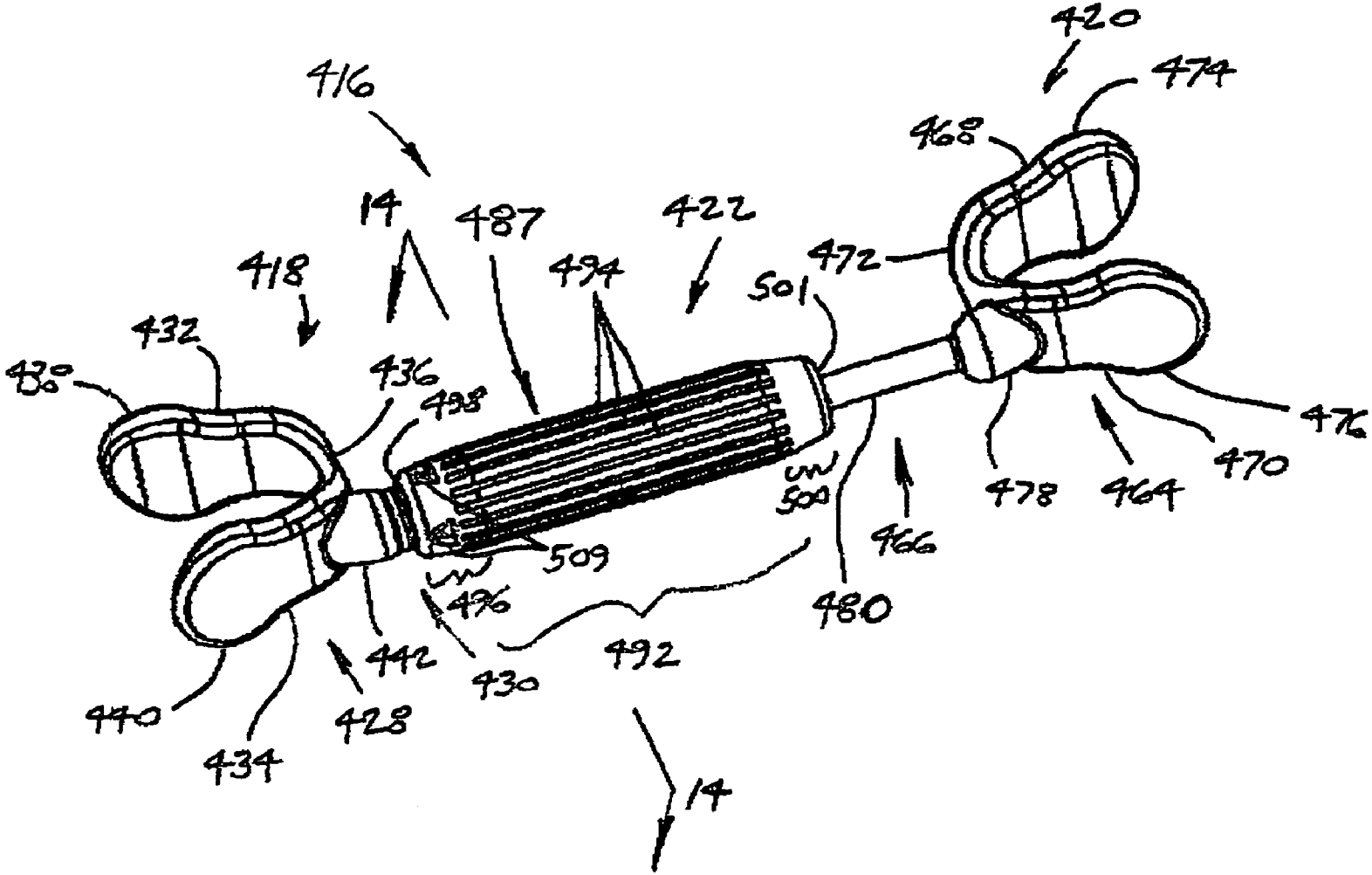
FIG. 13 is a perspective view of a fifth embodiment facial and neck muscle exercising device, showing first and second mouth spreading arms which slidably telescope together and a tubular housing rotatably disposed thereabout, the mouth spreading arms having respective U-shaped end members and dependent slide members.
Figure 14:
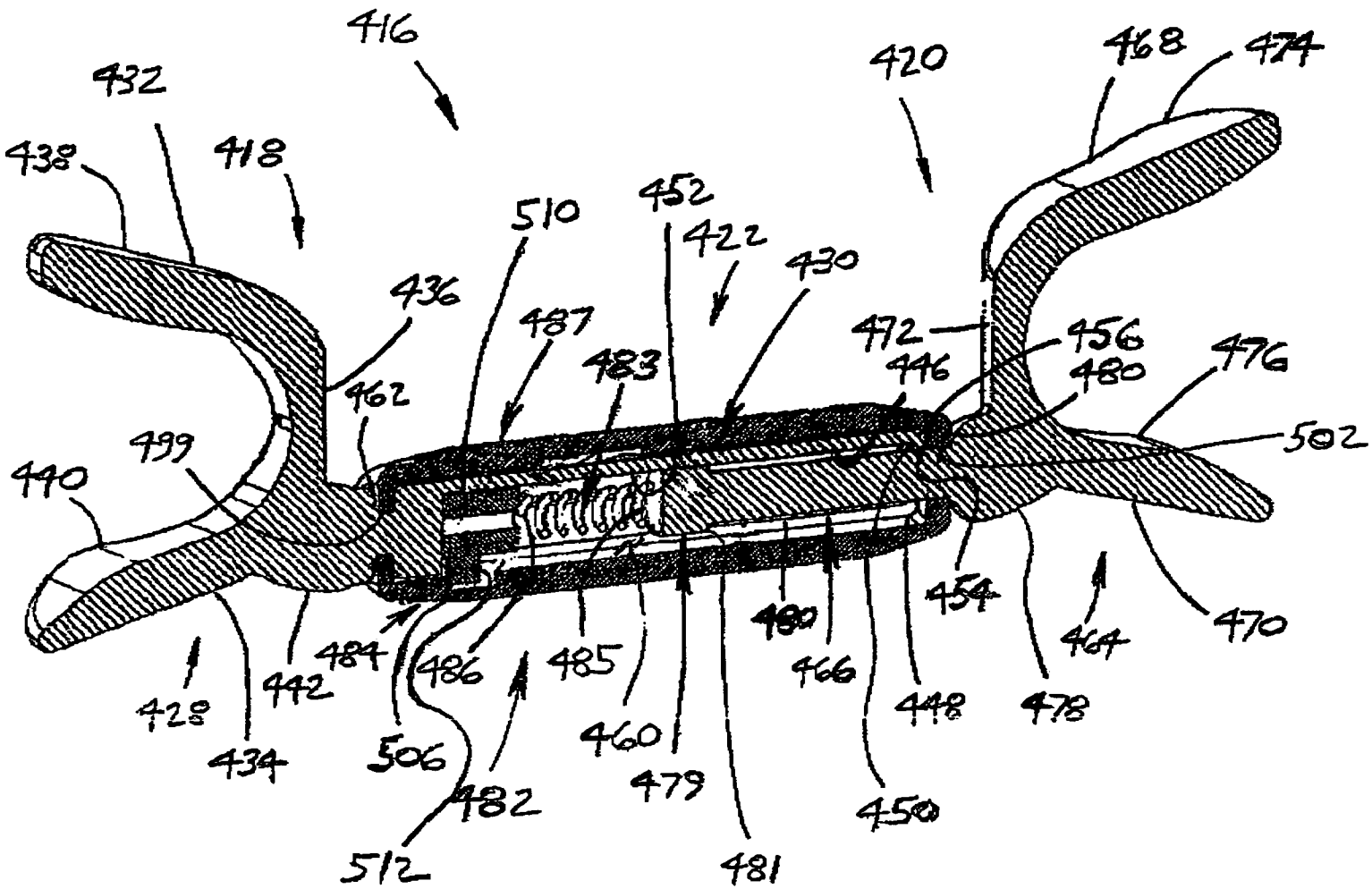
FIG. 14 is a longitudinal sectional perspective view of the exercising device to the enlarged scale taken on the line 14—14 of FIG. 13, showing the slide member of the first mouth spreading arm having a stepped slide bore with an internal locking shoulder, the slide member of the second mouth spreading arm having an external locking shoulder to prevent subsequent complete separation of the mouth spreading arms, the housing rotatably disposed about the slide members, and a compression spring and a tension adjuster disposed within the slide bore of the first mouth spreading arm.
Figure 15:
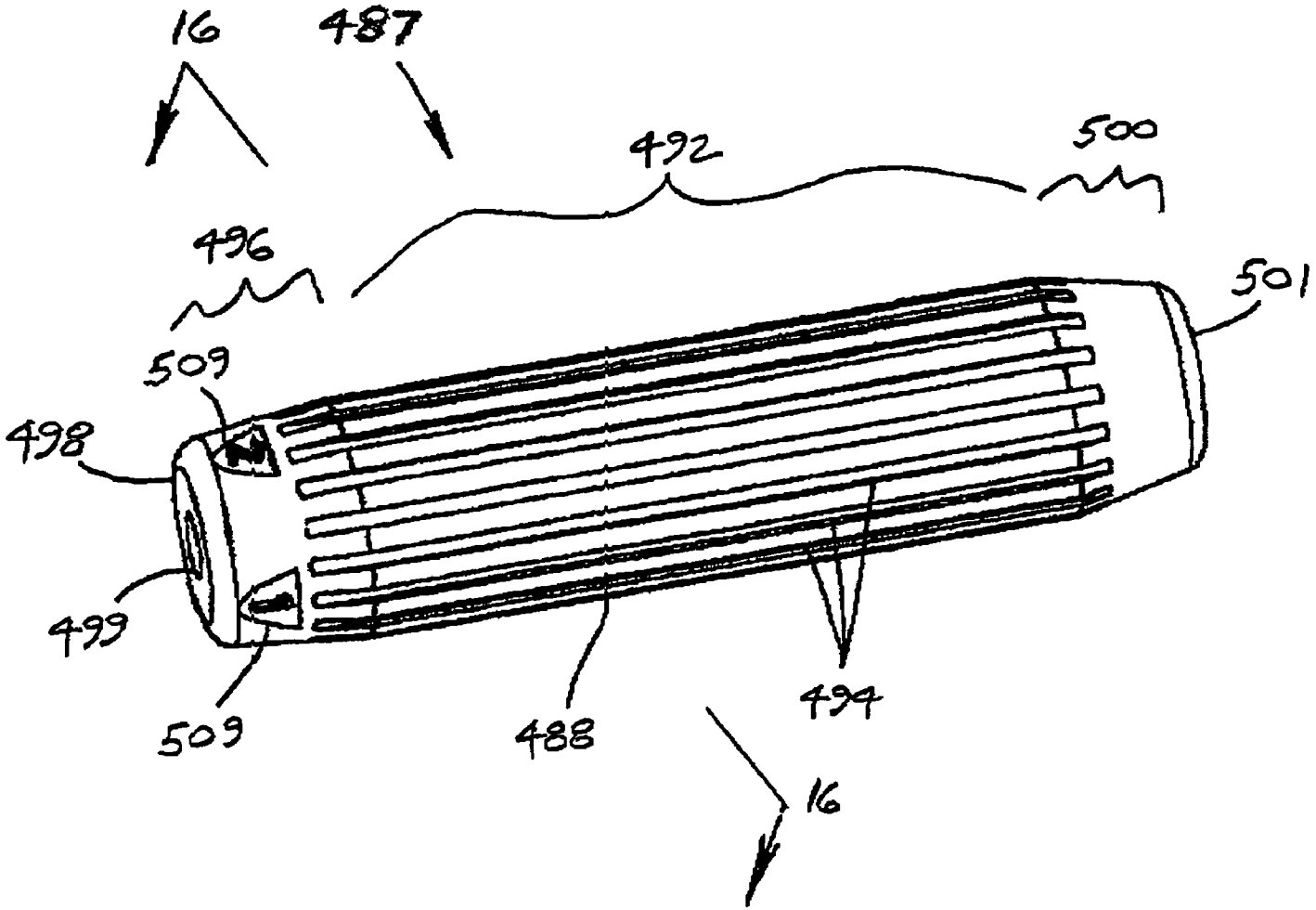
FIG. 15 is a perspective view of the housing to the further enlarge scale, showing a middle portion having a plurality of longitudinal ribs for gripping in-hand, a first end portion having an annular first stop wall with a hole therethrough and a second end portion having an annular second stop wall with a hole therethrough.
Figure 16:
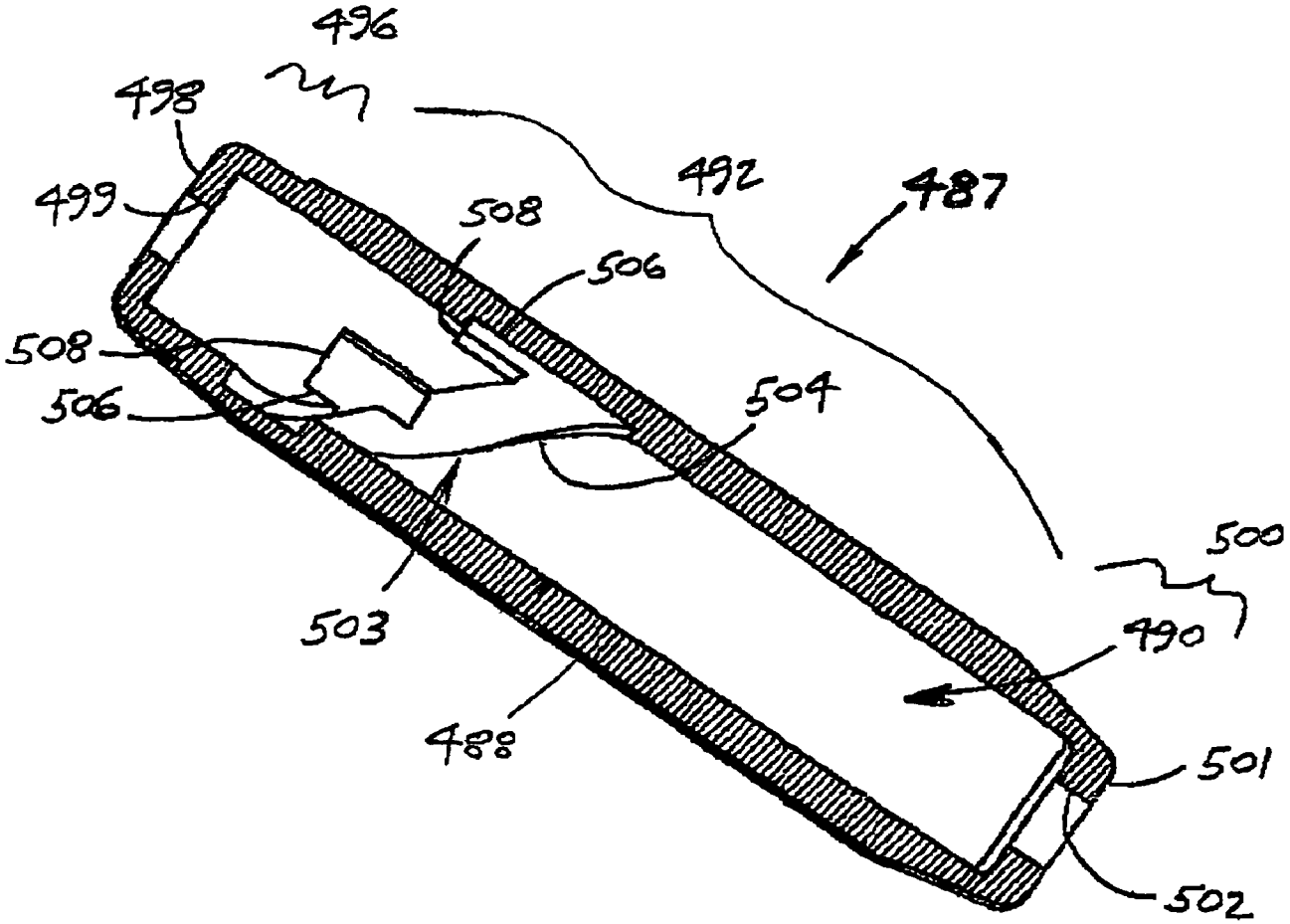
FIG. 16 is a longitudinal sectional perspective view of the housing to the further enlarged scale taken on the line 16—16 of FIG. 15, showing an annular wall which defines an internal chamber therein with a tension adjustment groove to slidably receive an end of the tension adjustment tab and with a plurality of tab receiving slots which define a plurality of resistance setting positions by rotating the housing.
Figure 17:
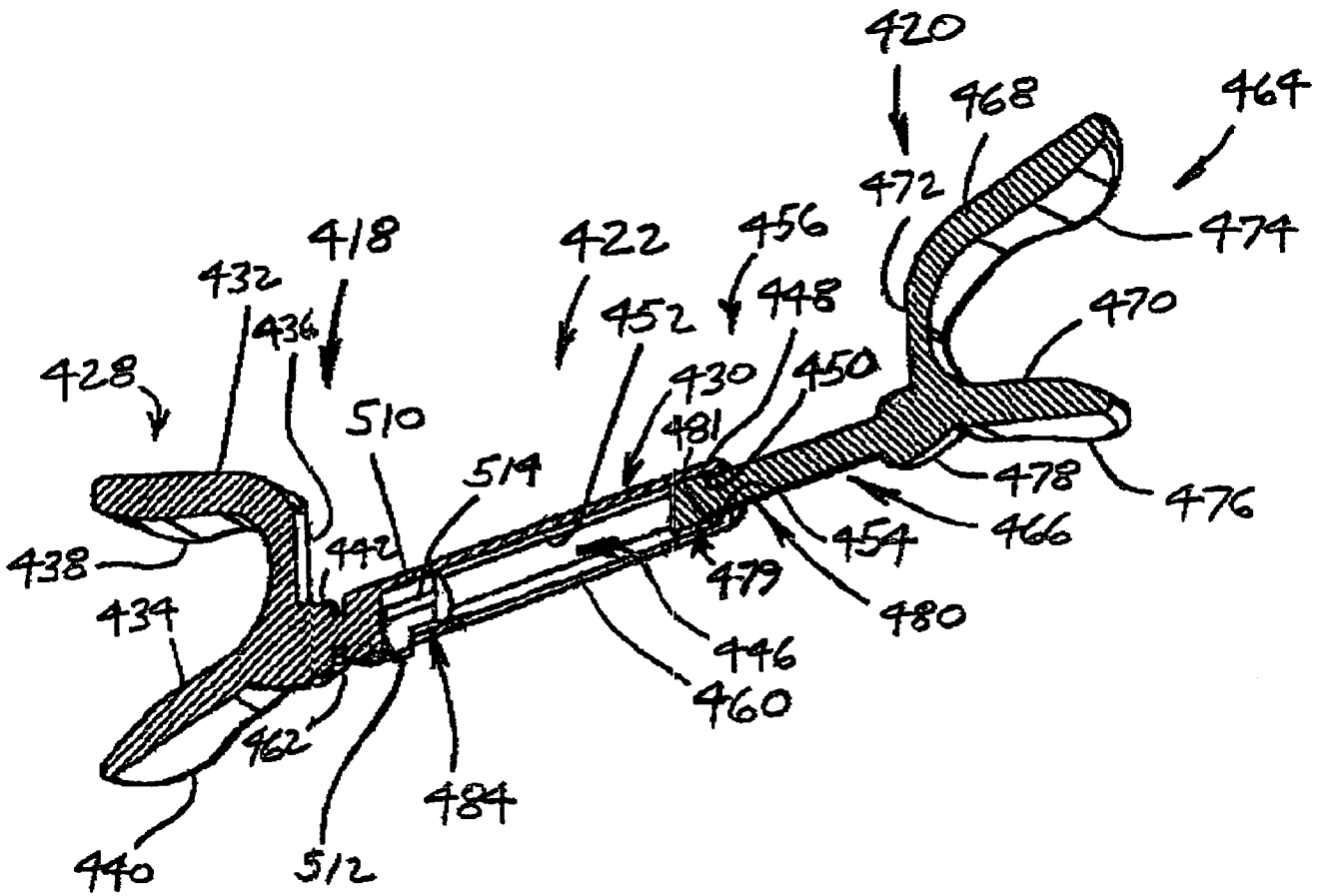
FIG. 17 is a longitudinal sectional perspective view of the exercising device to the enlarged scale corresponding to FIG. 17 but with the housing and compression spring removed, showing the tension adjuster having with a body disposed within the slide bore of the first mouth spreading arm with a tension adjustment tab which slides longitudinally along a guide slot of the slide member thereof to adjustably longitudinally bias the spreading arms.

Referring to FIGS. 11 and 12, a fourth embodiment facial and neck muscle exercising device 328 includes respective first and second mouth spreading arms 330 and 332 which slidably fit together in a ratcheting manner, and an arm retaining device 334 connected thereto to control relative sliding movement of the mouth spreading arms 330 and 332 as the muscles are flexed and relaxed during exercise.

The first mouth spreading arm 330 includes an end member 336 and a dependent slide member 338. The end member 336 is of U-shape to fit the upper and lower lips 32 and 34 at the corners 22 and 24 of the person's mouth 26, and includes respective inner and outer legs 340 and 342 which respectively extend internally and externally of the person's mouth 26 interconnected by a curved base leg 344. The first mouth spreading arm 330 includes comfort features including the inner and outer legs 340 and 342 legs diverging slightly and having middle portions 346 and 348 of increased surface area to fit comfortably to the person's lips 32 and 34. The first mouth spreading arm 330 further includes an additional comfort feature of having a forwardly curved portion 350 disposed between the end member 336 and the slide member 338 to position the exercising device 328 forward of the person's teeth (not shown).

The slide member 338 of the first mouth spreading arm 330 has a semi-circular support half 354 and an integral T-shaped flange 356. A plurality of attachment elements in the form of a plurality of ratchet teeth 360 disposed longitudinally along the slide member 338 extending inwardly therefrom which define a plurality of length setting positions. A pair of resilient wedges 364 extend inwardly dependent from a distal end 368 of the slide member 338 opposite the end member 336 each including a ramp surface 370 and a shoulder 372.

The second mouth spreading arm 332 includes an end member 374 and a dependent slide member 376. The end member 374 is of U-shape to fit the upper and lower lips 32 and 34 at the corners 22 and 24 of the person's mouth 26, and includes respective inner and outer legs 378 and 380 which respectively extend internally and externally of the person's mouth 26 interconnected by a curved base leg 382. The second mouth spreading arm 332 includes the comfort features including the inner and outer legs 378 and 380 diverging slightly and having middle portions 384 and 386 of increased surface area to fit comfortably to the person's lips 32 and 34. The second mouth spreading arm 332 further includes the additional comfort feature of having a forwardly curved portion 388 disposed between the end member 374 and the slide member 376 to position the exercising device 328 forward of the person's teeth.

The first and second mouth spreading arms 330 and 332 slidably fit together by the slide member 376 of the second mouth spreading arm 332 having a semi-circular support half 394 and a pair of integral L-shaped flanges 396 and 398 adapted to closely slidably fit to the T-shaped flange 356 in the horizontal direction but allow slight movement in the vertical direction.

The arm retaining device 334 prevents complete separation of the mouth spreading arms 330 and 332 by the slide member 376 having a pair of resilient wedges 400 that extend inwardly dependent from a distal end 402 of the slide member 376 opposite the end member 374 each including a ramp surface 404 and a locking shoulder 406. The wedges 364 and 400 flex slightly when the ramp surfaces 370 and 404 interact during initial sliding together of the mouth spreading arms 330 and 332 to deflect the wedges 364 and 400 to pass by one another. The locking shoulders 372 and 406 interact at full extension of the mouth spreading arms 330 and 332 to prevent subsequent complete separation thereof.

The arm retaining device 334 positions the end members 336 and 374 of the mouth spreading arms 330 and 332 at a desired spacing by the slide member 376 of the second mouth spreading arm 332 having a plurality of attachment elements in the form of a plurality of ratchet teeth 408 disposed longitudinally along the slide member 376 opposed to engage the ratchet teeth 360 of the first mouth spreading arm 330 extending inwardly therefrom define a plurality of resistance setting positions. The slide members 338 and 376 are biased to a locked position with the pluralities of ratchet teeth 360 and 408 engaged by an elongate resilient member in the form of a leaf spring 410, though a resilient strip, a resilient block, or other suitable member may be used. The leaf spring 410 is made of thin sheet spring steel, plastic, or other resilient material and includes a curved middle portion 412 and a pair of straight end tabs 414 that fit into respective slots 415 of the second mouth spreading arm 332. The leaf spring 410 is affixed to the slide member 376 and provides a force perpendicular to the ratchet teeth 360 and 408 to urge into engagement to retain to retain the end members 336 and 374 at the desired spacing during exercise and movable to an unlocked position by application of hand force in the perpendicular direction to flatten the leaf spring 410 and disengage the pluralities of ratchet teeth 360 and 408 to allow longitudinal slipping thereof past one another to adjust the desired spacing of the end members 336 and 374.

The exercising device 328 is used by the person 30 by first adjusting the length of the exercising device 328 by laterally moving the slide members 338 and 376 against the bias of the leaf spring 410 such that the pluralities of ratchet teeth 360 and 408 disengage and longitudinal moving the slide members 336 and 374 such that the ratchet teeth 360 of the first mouth spreading arm 330 pass the ratchet teeth 408 of the second mouth spreading arm 332 to engage desired thereof. The exercising device 328 is then placed at the opening 28 of the mouth 26 with the end members 336 and 374 respectively engaging the corners 22 and 24 of the mouth 26. The curved portions 350 and 388 of the spreading arms 330 and 332 curve forwardly to provide clearance for the person's teeth. The person 30 exercises the facial muscles by contracting and enlarging the opening 28 of the mouth 26 against the resistance of the exercising device 328 to exercise the facial muscles around the mouth and throughout the face.

Fifth Preferred Embodiment

Referring to FIGS. 13–17, a fifth embodiment facial and neck muscle exercising device 416 includes respective first and second mouth spreading arms 418 and 420 which slidably telescope together, and an arm retaining device 422 connected thereto to control relative sliding movement of the mouth spreading arms 418 and 420 as the muscles are flexed and relaxed during exercise.

The first mouth spreading arm 418 includes an end member 428 and a dependent slide member 430. The end member 428 is of U-shape to fit the upper and lower lips 32 and 34 at the corners 22 and 24 of the person's mouth 26, and includes respective inner and outer legs 432 and 434 which respectively extend internally and externally of the person's mouth 26 interconnected by a curved base leg 436. The first mouth spreading arm 418 includes comfort features including the inner and outer legs 432 and 434 diverging slightly and having middle portions 438 and 440 of increased surface area to fit comfortably to the person's lips 32 and 34. The first mouth spreading arm 418 further includes an additional comfort feature of having a forwardly curved portion 442 disposed between the end member 428 and the slide member 430 to position the exercising device 416 forward of the person's teeth (not shown).

The slide member 430 of the first mouth spreading arm 418 has a stepped slide bore 446 which extends into a distal end 448 thereof opposite end member 428 with an internal locking shoulder 450. The slide bore 446 includes a larger slide portion 452 of polygonal cross-section, preferably hexagonal, and a smaller guide portion 454 of round cross-section formed by an annular flange 456 which extends inwardly into the slide bore 446 at the distal end 448 of the slide member 430 which together define the internal locking shoulder 457 therebetween. A longitudinal guide slot 460 extends longitudinally inwardly from the distal end 448. An annular external retaining groove 462 is disposed at the curved portion 442 between the end member 428 and the slide member 430.

The second mouth spreading arm 420 includes an end member 464 and a dependent slide member 466. The end member 464 is of U-shape to fit the upper and lower lips 32 and 34 at the corners 22 and 24 of the person's mouth 26, and includes respective inner and outer legs 468 and 470 which respectively extend internally and externally of the person's mouth 26 interconnected by a curved base leg 472. The second mouth spreading arm 420 includes the comfort features including the inner and outer legs 468 and 470 diverging slightly and having middle portions 474 and 476 of increased surface area to fit comfortably to the person's lips 32 and 34. The second mouth spreading arm 420 further includes the additional comfort feature of having a forwardly curved portion 478 disposed between the end member 464 and the slide member 466 to position the exercising device 416 forward of the person's teeth.

The first and second mouth spreading arms 418 and 420 slidably telescope together by the slide member 466 of the second mouth spreading arm 420 being closely slidably received in the guide portion 454 of slide bore 446 in a telescoping manner.

The arm retaining device 422 prevents complete separation of the mouth spreading arms 418 and 420 by the slide member 466 having a head 479 of mating polygonal cross-section, preferably hexagonal cross-section, which closely slidably fits into the slide portion 452 of slide bore 446, and a round center portion 480 adapted to closely slidably fit into the guide portion 454 of slide bore 446. An external locking shoulder 481 engages the internal locking shoulder 457 of the first mouth spreading arm 418 at fill extension of the mouth spreading arms 418 and 420 to prevent subsequent complete separation thereof.

The arm retaining device 422 longitudinally biases the end members 428 and 464 by including a spring device 482 which includes a spring member in the form of a compression spring 483 disposed within the slide bore 446 between a tension adjuster 484 and the slide member 466 of the second mouth spreading arm 420 which provides a longitudinal force resistant to relative sliding movement of the mouth spreading arms 418 and 420 to longitudinally bias the end members 428 and 464. The compression spring 483 has opposite first and second ends 485 and 486 retained to respective of the slide members 430 and 466 of the mouth spreading arms 418 and 420.

The spring device 482 is of adjustable bias by including a hollow tubular housing 487 and the tension adjuster 484. The housing 487 is rotatably disposed about the slide members 430 and 466 and is comprised of an annular wall 488 which defines an internal chamber 490 therein. A middle portion 492 of housing 487 is adapted to be gripped in-hand by having a plurality of longitudinal ribs 494. Housing 487 further includes a first end portion 496 having an annular first end wall 498 with a hole 499 therethrough and a second end portion 500 having an annular second end wall 501 with a hole 502 therethrough. An elongate tension adjustment groove 503 includes a semi-spiral groove 504 with a plurality of attachment elements in the form of dependent tension adjustment slots 506 disposed within the interior chamber 490 extending longitudinally from the semi-spiral groove 504 toward the first end wall 498 and which terminate at respective stop shoulders 508 to define a plurality of resistance setting positions. The semi-spiral groove 504 and the tension adjustment slots 506 are of rectangular shaped cross-section. The semi-spiral groove 504 and tension adjustment slots 506 are of mating configuration to slidably interact with the tension adjuster 484 as explained below. A plurality of numbered arrows 509 are disposed at the first end portion 496 of housing 487 corresponding to respective of the tension adjustment slots 506.

The tension adjuster 484 includes a body 510 of mating polygonal cross-section, preferably hexagonal cross-section, which closely slidably fits into the slide portion 452 of slide bore 446 within the first mouth spreading arm 418. A tension adjustment tab 512 of circular shaped cross-section extends radially outwardly from body 510 which extends through and slides longitudinally along the guide slot 460 of the first mouth spreading arm 418. A vent hole 514 extends centrally through the body 510 to equalization of pressure within the slide bore 446 during sliding therein. The tension adjustment tab 512 extends into and is slidable along the semi-spiral groove 504 by rotating the housing 487 and be disposed in a selected of the tension adjustment slots 506 of tension adjustment groove 503.

The exercising device 416 is used by the person 30 by first adjusting the resistance (pre-load) on the compression spring 483 by longitudinally moving the second mouth spreading arm 420 to remove any longitudinal force from the tension adjuster 484. This allows the housing to be rotated to slide the tension adjustment tab 512 out of one tension adjustment slot 506 and along the semi-spiral groove 504 into another desired thereof. The tension adjuster 484 resultantly moves longitudinally within the slide bore 446 to change the position of the second end 486 of the compression spring 483. The tension adjustment tab 512 is moved into a desired of the tension adjustment slots 506 of the tension adjustment groove 503 using the numbered arrows 509 of the housing 487 as a guide. The exercising device 416 is then longitudinally squeezed using the thumb and index finger against respective of the end members 428 and 464 to compress the compression spring 483 sufficiently to be placed at the opening 28 of the mouth 26 with the end members 428 and 464 respectively engaging the corners 22 and 24 of the mouth 26. The end members 428 and 464 are then released to bias the corners 22 and 24 of the mouth 26. The curved portions 442 and 478 of the spreading arms 418 and 420 curve forwardly to provide clearance for the person's teeth. The person 30 exercises the facial muscles by contracting and enlarging the opening 28 of the mouth 26 against the resistance of the compression spring 483 to exercise the facial muscles around the mouth and throughout the face.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teaching herein are particularly reversed especially as they fall within the breadth and scope of the claims here appended.

I claim as my invention:

1. A facial and neck muscle exercising device for positioning against opposite corners of a person's mouth at an opening thereof to strengthen facial and mouth muscles, comprising:

first and second mouth spreading arms which include respective end members that are spaced apart and adapted to engage the opposite corners of the person's mouth and respective elongate side members slidably connected together to vary the spacing of said end members; and an arm retaining device connected to said slide members adapted to control relative sliding movement of said mouth spreading arms to control said spacing and movement of said end members against the corners of the person's mouth as the muscles are flexed and relaxed during exercise, the slide member of the first mouth spreading arm has a slide bore which extends into a distal end thereof opposite its end member and the slide member of the second mouth spreading arm is adapted to be closely slidably received in said slide bore in a telescoping manner the arm retaining device is adapted to prevent complete separation of the mouth spreading arms by said first mouth spreading arm having an internal locking shoulder formed within the slide bore at the distal end of its slide member and the slide member of said second mouth spreading arm having at least one resilient retaining tab which extends radially outwardly from a distal end thereof opposite its end member, each retaining tab being adapted to flex radially inwardly to allow passage thereof into said slide bore and having an external locking shoulder adapted to engage said internal locking shoulder at full extension of said mouth spreading arms to prevent subsequent complete separation thereof.

2. The exercising device of claim 1, wherein the end members are of substantially U shape to fit the corners of the person's mouth comprising respective inner and outer legs adapted to respectively extend internally and externally of the person's mouth interconnected by a curved base leg, each mouth spreading arm including at least one comfort feature chosen from the group consisting of said legs diverging slightly, said legs having middle portions of increased surface area, and said mouth spreading arms having a forwardly curved portion disposed between said end member and the slide member.

3. The exercising device of claim 1, wherein the slide bore is of polygonal crosssection and the slide member of the second mouth spreading arm comprises a head of mating polygonal cross-section to said head and a connecting portion of smaller crosssection which connects said head to the end member thereof.

4. The exercising device of claim 3, wherein the slide bore comprises a stepped bore including a larger slide portion and a smaller guide portion formed by an annular flange which extends inwardly into said slide bore at the distal end of the slide member adapted to closely slidably receive the connecting portion which together define the internal locking shoulder adapted to retain said head within said slide bore.

5. The exercising device of claim 1, wherein the second mouth spreading arm has a tab clearance bore which extends into the distal end of its slide member and there are a plurality of the retaining tabs formed as part of an annular external flange at said distal end defined by a plurality of tab slits which extend longitudinally inwardly from its distal end.

6. The exercising device of claim 1, wherein the arm retaining device is adapted to retain the end members at a desired spacing by the slide members having respective opposing pluralities of ratchet teeth which extend longitudinally therealong, said slide members being adapted to allow slight relative movement in a direction perpendicular thereto, being biased to a locked position with said pluralities of ratchet teeth engaged by at least one resilient member chosen from the group consisting of a leaf spring, a resilient strip, and a resilient block affixed to at least one of said slide members to retain said end members at said desired spacing during exercise and movable to an unlocked position by application of hand force in said perpendicular direction to disengage said pluralities of ratchet teeth and allow longitudinal slipping thereof past one another to adjust said desired spacing of said end members.

7. A facial and neck muscle exercising device for positioning against opposite corners of a person's mouth at an opening thereof to strengthen facial and mouth muscles, comprising:

first and second mouth spreading arms which include respective end members that are spaced apart and adapted to engage the opposite corners of the person's mouth and respective elongate slide members slidably connected together to vary the spacing of said end members; and an arm retaining device connected to said slide members adapted to control relative sliding movement of said mouth spreading arms to control said spacing and movement of said end members against the corners of the person's mouth as the muscles are flexed and relaxed during exercise, the arm retaining device is adapted to retain the end members at a desired spacing by including a tubular spacer disposed about the slide members having a first end adapted to be secured to said slide member of said first mouth spreading arm at a single position and a second end adapted to be secured to said slide member of said second mouth spreading arm at a plurality of positions using a retaining combination chosen from the group consisting of at least one each of a length adjustment depression disposed in said slide member of said second mouth spreading arm and a length adjustment pin inwardly dependent from said second end adapted to engage said depression, and a plurality of length adjustment pins longitudinally spaced along said slide member of said second mouth spreading arm and an annular end wall inwardly dependent from said second end with a central hole which defines an inner periphery thereof adapted to closely fit about said slide member and individually engage ribs as said slide member is moved.

8. The exercising device of claim 7, wherein each depression comprises a length adjustment groove disposed along the slide member of the second mouth spreading arm each having a plurality of length adjustment portions interconnected by a plurality of stop portions which respectively extend generally longitudinally and transversely thereof: each length adjustment pin being adapted to slidably engage a corresponding of said length adjustment grooves, said pins and corresponding length adjustment grooves being of a number and disposition chosen from the group consisting one disposed radially anywhere on said slide member and two disposed radially oppositely one another such that said length adjustment pins can slide along the corresponding length adjustment grooves in unison as the spacer is moved.

9. A facial and neck muscle exercising device for positioning against opposite corners of a person's mouth at an opening thereof to strengthen facial and mouth muscles, comprising:

first and second mouth spreading arms which include respective end members that are spaced apart and adapted to engage the opposite corners of the person's mouth and respective elongate slide members slidably connected together to vary the spacing of said end members; and an arm retaining device connected to said slide members adapted to control relative sliding movement of said mouth spreading arms to control said spacing and movement of said end members against the corners of the person's mouth as the muscles are flexed and relaxed during exercise, the slide member of the first mouth spreading arm has a slide bore which extends into a distal end thereof opposite its end member and the slide member of the second mouth spreading arm is adapted to be closely slidably received in said slide bore in a telescoping manner, the arm retaining device is adapted to prevent complete separation of said mouth spreading arms by having an internal locking shoulder formed within said slide bore at said distal end of its slide member and said slide member of said second mouth spreading arm having a tab clearance bore which extends into a distal end thereof opposite its end member and a pair of resilient retaining tabs which extend radially outwardly from said distal end formed as part of an annular external flange defined by a plurality of tab slits which extend longitudinally inwardly from said distal end, said retaining tabs being adapted to flex radially inwardly to allow passage thereof into said slide bore and having an external locking shoulder adapted to engage said internal locking shoulder at a fully extended position of said mouth spreading arms, said arm retaining device being adapted to longitudinally bias and retain said end members at a desired spacing by including a bellows tube disposed about said slide members of adjustable bias adapted to provide a longitudinal force resistant to relative sliding movement of said mouth spreading arms having a first end adapted to connect to said slide member of said first mouth spreading arm at a plurality of tension adjustment tabs disposed longitudinally there along which define a plurality of resistance setting positions and a mating tension adjustment slot at said first end of said bellows tube, a middle comprised of a plurality of resilient bellows, and a second end adapted to be secured to said slide member of said second mouth spreading am, at a plurality of positions using a pair of length adjustment grooves disposed radially oppositely on said slide member of said second mouth spreading arm each having a plurality of length adjustment portions interconnected by a plurality of stop portions which respectively extend generally longitudinally and transversely thereof, and a pair of length adjustment pins inwardly dependent from said second end adapted to slidably engage corresponding of said length adjustment grooves in unison as said spacing member is moved, and wherein said end members are of substantially U-shape to fit the corners of the person's mouth comprising respective inner and outer legs adapted to respectively extend internally and externally of the person's mouth interconnected by a curved base leg, each of said mouth spreading arms including at least one comfort feature chosen from the group consisting of said end members having legs which diverging slightly, said end members having legs with middle portions of increased surface area, and said mouth spreading arms having a forwardly curved portion disposed between said end member and said slide member.

10. A facial and neck muscle exercising device for positioning against opposite corners of a person's mouth at an opening thereof to strengthen facial and mouth muscles, comprising:

first and second mouth spreading arms which include respective end members that are spaced apart and adapted to engage the opposite corners of the person's mouth and respective elongate slide members slidably connected together to vary the spacing of said end members; and an arm retaining device connected to said slide members adapted to control relative sliding movement of said mouth spreading arms to control said spacing and movement of said end members against the corners of the person's mouth as the muscles are flexed and relaxed during exercise, wherein the slide member of the first mouth spreading arm has a slide bore which extends into a distal end thereof opposite its end member and the slide member of the second mouth spreading arm is adapted to be closely slidably received in said slide bore in a telescoping manner, the arm retaining device is adapted to prevent complete separation of the mouth spreading arms by said first mouth spreading arm having an internal locking shoulder formed within the slide bore at the distal end of its slide member and the slide member of said second mouth spreading arms having an external locking shoulder adapted to engage said internal locking shoulder of said first mouth spreading arm at full extension of said mouth spreading arms to prevent subsequent complete separation thereof: said slide bore of said first mouth spreading arm being of polygonal cross-section comprising a stepped bore including a larger slide portion and a smaller guide portion formed by an annular flange which extends inwardly into said slide bore at said distal end of said slide member and said slide member of said second mouth spreading arm comprises a head of mating polygonal cross-section to said head and a connecting portion of smaller cross-section which connects said head to the end member thereof: said slide portion being adapted to closely slidably receive said connecting portion of said second mouth spreading arm which together with said guide portion defines said internal locking shoulder adapted to retain said head within said slide bore, wherein said arm, retaining device is adapted to longitudinally bias said end members by including a spring device of adjustable bias adapted to provide a longitudinal force resistant to relative sliding movement of said mouth spreading arms by having a tension adjuster comprising a body adapted to closely slidably fit within said slide bore having a tension adjustment tab that extends radially outwardly from said body through a longitudinal guide slot of said slide member, a compression spring disposed within said slide bore between said tension adjuster and the slide member of said second mouth spreading arm adapted to longitudinally bias said mouth spreading arms, and a tubular housing rotatably disposed about said slide members having a semi-spiral tension adjustment groove with a plurality of attachment elements in the form of dependent tab receiving slots that extend longitudinally therein and terminate at respective stop shoulders to define a plurality of resistance setting positions adapted to receive selected of said tension adjustment tabs by rotating said housing, and wherein said end members are of substantially U shape to fit the corners of the person's mouth comprising respective inner and outer legs adapted to respectively extend internally and externally of the person's mouth interconnected by a curved base leg, each of said mouth spreading arms including at least one comfort feature chosen from the group consisting of said end members having legs which diverging slightly, said end members having legs with middle portions of increased surface area, and said mouth spreading arms having a forwardly curved portion disposed between said end member and said slide member.

* * * * *